US009490511B2

(12) United States Patent
Ueda et al.

(10) Patent No.: US 9,490,511 B2
(45) Date of Patent: Nov. 8, 2016

(54) NONRECIPROCAL TRANSMISSION LINE APPARATUS WHOSE PROPAGATION CONSTANTS IN FORWARD AND BACKWARD DIRECTIONS ARE DIFFERENT FROM EACH OTHER

(71) Applicant: JAPAN SCIENCE AND TECHNOLOGY AGENCY, Saitama (JP)

(72) Inventors: Tetsuya Ueda, Ibaraki (JP); Andrey Porokhnyuk, Kyoto (JP)

(73) Assignee: JAPAN SCIENCE AND TECHNOLOGY AGENCY, Saitama (JP)

( * ) Notice: Subject to any disclaimer, the term of this patent is extended or adjusted under 35 U.S.C. 154(b) by 0 days.

(21) Appl. No.: 14/772,239

(22) PCT Filed: Feb. 25, 2014

(86) PCT No.: PCT/JP2014/054552

§ 371 (c)(1),
(2) Date: Sep. 2, 2015

(87) PCT Pub. No.: WO2014/136621

PCT Pub. Date: Sep. 12, 2014

(65) Prior Publication Data

US 2016/0006092 A1 Jan. 7, 2016

(30) Foreign Application Priority Data

Mar. 4, 2013 (JP) ..... 2013-042156

(51) Int. Cl.
*H01P 1/32* (2006.01)
*H01P 1/19* (2006.01)
(Continued)

(52) U.S. Cl.
CPC . *H01P 1/19* (2013.01); *H01P 1/32* (2013.01); *H01P 3/08* (2013.01); *H01Q 13/20* (2013.01)

(58) Field of Classification Search
CPC ..... H01P 1/32; H01P 3/08
USPC ..... 333/24.1, 236, 238
See application file for complete search history.

(56) References Cited

U.S. PATENT DOCUMENTS

2010/0060388 A1 3/2010 Ueda
2013/0321093 A1 12/2013 Ueda et al.

FOREIGN PATENT DOCUMENTS

WO 2008/111460 9/2008
WO 2011/024575 3/2011
WO 2012/115245 8/2012

OTHER PUBLICATIONS

International Preliminary Report on Patentability and Written Opinion of the International Searching Authority mailed Sep. 17, 2015 in International (PCT) Application No. PCT/JP2014/054552.
(Continued)

*Primary Examiner* — Stephen E Jones
(74) *Attorney, Agent, or Firm* — Wenderoth, Lind & Ponack, L.L.P.

(57) ABSTRACT

When a phase constant in a first mode of propagation in the forward direction is $\beta_p$, and a phase constant in a second mode of propagation in the backward direction is $\beta_m$, respective first and second electrical lengths of stub conductors are set so that a function of nonreciprocal phase shift amount $\beta_{NR}=(\beta_p-\beta_m)/2$ with respect to an operating angular frequency comes close to a function $\beta_{NRZ}$ with respect to an operating angular frequency, when beam squint of such a phenomenon that a radiation direction of electromagnetic waves radiated from a nonreciprocal transmission line apparatus changes in accordance with frequency does not occur in the vicinity of an intersection of a dispersion curve representing a relation between the phase constant $\beta_p$ and the operating angular frequency and a dispersion curve representing a relation between the phase constant $\beta_m$ and the operating angular frequency.

7 Claims, 28 Drawing Sheets

(51) Int. Cl.
*H01P 3/08* (2006.01)
*H01Q 13/20* (2006.01)

(56) References Cited

OTHER PUBLICATIONS

International Search Report issued Jun. 3, 2014 in International (PCT) Application No. PCT/JP2014/054552.
Tsutsumi et al., "Nonreciprocal Left-Handed Microstrip Lines Using Ferrite Substrate", IEEE MTT-S International Microwave Symposium Digest, vol. 1, 2004, pp. 249-252.
Ueda et al., "Pseudo-Traveling-Wave Resonator With Magnetically Tunable Phase Gradient of Fields and Its Applications to Beam-Steering Antennas", IEEE Transactions on Microwave Theory and Techniques, vol. 60, No. 10, Oct. 2012, pp. 3043-3054.
Hines, "Reciprocal and Nonreciprocal Modes of Propagation in Ferrite Stripline and Microstrip Devices", IEEE Transactions on Microwave Theory and Techniques, vol. MTT-19, No. 5, May 1971, pp. 442-451.
Porokhnyuk et al., "Mode Analysis of Nonreciprocal Metamaterials Using a Combination of Field Theory and Transmission Line Model", 2012 IEEE MTT-S International Microwave Symposium Digest, WE4J-5, Jun. 2012, pp. 1-3.
Ueda et al., "Nonreciprocal Phase-Shift CRLH Transmission Lines Using Geometrical Asymmetry with Periodically Inserted Double Shunt Stubs", Proceedings of the 42nd European Microwave Conference, Oct. 2012, pp. 570-573.
Abdalla et al., "Design and Analysis of Tunable Left Handed Zeroth-Order Resonator on Ferrite Substrate", IEEE Transactions on Magnetics, vol. 44, No. 11, Nov. 2008, pp. 3095-3098.
Garakoui et al., "Phased-Array Antenna Beam Squinting Related to Frequency Dependency of Delay Circuits", Proceedings of the 41st European Microwave Conference, Oct. 2011, p. 1304-1307.
Antoniades et al., "A CPS Leaky-Wave Antenna With Reduced Beam Squinting Using NRI-TL Metamaterials", IEEE Transactions on Antennas and Propagation, vol. 56, No. 3, Mar. 2008, pp. 708-721.
Nguyen et al., "Analog Dispersive Time Delayer for Beam-Scanning Phased Array Without Beam-Squinting", 2008 IEEE AP-S International Symposium, Digital Object Identifier: 10.1109/APS.2008.4619097, 2008, 4 pages.

NONRECIPROCAL TRANSMISSION LINE APPARATUS WHOSE PROPAGATION CONSTANTS IN FORWARD AND BACKWARD DIRECTIONS ARE DIFFERENT FROM EACH OTHER

TECHNICAL FIELD

The present invention relates to a nonreciprocal transmission line apparatus whose propagation constant in a forward direction and propagation constant in a backward direction are different from each other, and further relates to an antenna apparatus including the same nonreciprocal transmission line apparatus.

BACKGROUND ART

A composite right/left-handed transmission line (hereinafter, referred to as a CRLH (Composite Right/left-Handed) transmission line) has been known as one of metamaterials. The CRLH transmission line is configured by substantially periodically inserting capacitive elements in series branch of the transmission line and substantially periodically inserting inductive elements in shunt branch, at intervals sufficiently smaller than the wavelength so as to have a negative effective permeability and a negative effective dielectric constant in a predetermined frequency band. In recent years, a nonreciprocal phase shift CRLH transmission line obtained by adding a nonreciprocal transmission function to the CRLH transmission line has been proposed (See, for example, Patent Documents 1 to 3). The nonreciprocal phase shift CRLH transmission line is able to exhibit a positive refractive index when electromagnetic waves having an identical frequency propagate in the forward direction and to exhibit a negative refractive index when the electromagnetic waves propagate in the backward direction.

When the transmission line resonator is configured by using the nonreciprocal phase shift CRLH transmission line, the resonator size can be freely changed without changing the resonance frequency. Further, the electromagnetic field distribution on the resonator is similar to the electromagnetic field distribution of a traveling wave resonator. Therefore, by using a transmission line resonator having the nonreciprocal phase shift CRLH transmission line, a pseudo traveling wave resonator can be configured such that an amplitude of the electromagnetic field of the pseudo traveling wave resonator is uniform and a phase of the electromagnetic field of the pseudo traveling wave resonator linearly changes with a constant gradient along the transmission line. In this case, the phase gradient of the electromagnetic field distribution on the resonator is determined by the nonreciprocal phase shift characteristic of the transmission line configuring the resonator. Hereinafter, the transmission line apparatus using the nonreciprocal phase shift CRLH transmission line is referred to as a nonreciprocal transmission line apparatus.

The metamaterials have been a very interesting important theme in the field of applications to antennas for more than a decade. The nonreciprocal CRLH metamaterial has been proposed for the purpose of applications to directional leaky wave antenna using the CRLH transmission line until now. Moreover, recently, an antenna based on the pseudo traveling wave resonator highly developed from the zeroth-order resonator (See, for example, Non-Patent Document 1) has been proposed, so that the gain and the directivity are increased in spite of compactness as compared with the conventional leaky wave antenna.

Many ones of the nonreciprocal transmission line apparatuses that have been proposed until now adopt such a structure that a ferrite rod perpendicularly magnetized is embedded under the strip line at the center of the composite right/left-handed transmission line apparatus configured of the conventional microstrip line. In this case, the direction of the radiation beam from the antenna apparatus having the pseudo traveling wave resonator configured of the nonreciprocal transmission line apparatus is determined by the phase gradient of the electromagnetic field distribution on the resonator. Moreover, if the ferrite is a soft magnetic material, the nonreciprocal phase shift characteristic of the transmission line is changed by changing the magnitude or the direction of an externally applied magnetic field, and beam scanning can consequently be performed.

For example, Non-Patent Document 1 proposes application of the pseudo traveling wave resonator having the nonreciprocal transmission line apparatus to a beam-scanning antenna. The beam scanning antenna having the pseudo traveling wave resonator has such a drawback that the operation band is narrow, however, the beam scanning antenna has higher radiation efficiency than that of the conventional leaky wave antenna. Further, the problem of the occurrence of beam squint, which is such a phenomenon that the radiation beam direction changes in accordance with the frequency change of the propagation signal, is largely reduced.

The beam squint is a phenomenon well known in the conventional phased array antenna, or such a phenomenon that the beam radiation angle fluctuates depending on the frequency. The operation bandwidth is disadvantageously suppressed by this (See, for example, Non-Patent Document 6). In the ordinary array antenna, the main cause of the beam squint is in the dispersibility of the delay element. As one method for solving this, there can be enumerated a tunable time delay element used as an active CRLH delay element disclosed in Non-Patent Document 8. In the case of the CRLH metamaterial, this kind of compensation circuit is meaningless, and it has been possible to reduce the beam squint only in the upper bands of the series resonance frequency of the series branch and the parallel resonance frequency of the shunt branch (See, for example, Non-Patent Document 7).

PRIOR ART DOCUMENTS

Patent Documents

Patent Document 1: International Application Publication No. WO2008/111460A;

Patent Document 2: International Application Publication No. WO2011/024575A; and Patent Document 3: International Application Publication No. WO2012/115245A.

Non-Patent Document 1: T. Ueda et al., "Pseudo traveling-wave resonator with magnetically tunable phase gradient of fields and its applications to beam steering antennas", IEEE Transactions on Microwave Theory and Techniques, vol. 60, no. 10, pp. 3043-3054, October 2012;

Non-Patent Document 2: M. E. Hines, "Reciprocal and nonreciprocal modes of propagation in ferrite stripline and microstrip devices", IEEE Transactions on Microwave Theory and Techniques, vol. MTT-19, no. 5, pp. 442-451, May 1971;

Non-Patent Document 3: A. Porokhnyuk et al., "Mode analysis of nonreciprocal metamaterials using a combination of field theory and transmission line model", 2012

IEEE MTT-S International Microwave Symposium Digest, WE4J-5, pp. 1-3, June 2012;

Non-Patent Document 4: T. Ueda et al., "Nonreciprocal phase-shift CRLH transmission lines using geometrical asymmetry with periodically inserted double shunt stubs", Proceedings of the 42nd European Microwave Conference, pp. 570-573, October 2012;

Non-Patent Document 5: A. Mahmoud et al., "Design and analysis of tunable left handed zeroth-order resonator on ferrite substrate", IEEE Transactions on magnetics, vol. 44, no. 11, pp. 3095-3098, November 2008;

Non-Patent Document 6: S. K. Garakoui et al., "Phased-array antenna beam squinting related to frequency dependency of delay circuits", Proceedings of the 41st European Microwave Conference, pp. 1304-1307, October 2011;

Non-Patent Document 7: M. A. Antoniades et al., "A CPS leaky-wave antenna with reduced beam squinting using NRI-TL metamaterials", IEEE Transactions on antennas and propagation, vol. 56, no. 3, March 2008; and Non-Patent Document 8: H. V. Nguyen et al., "Analog dispersive time delayer for beam-scanning phased-array without beam-squinting", 2008 IEEE AP-S International Symposium, Digital Object Identifier: 10.1109/APS.2008.4619097, 2008.

DISCLOSURE OF INVENTION

Problems to be Dissolved by the Invention

In a reciprocal zeroth-order resonant leaky wave antenna, any problem of the beam squint does not occur. Because the dispersion characteristic of the traveling wave propagating in one direction is completely cancelled by the dispersion characteristic of the reflected wave propagating in the opposite direction. However, the resonance type leaky wave antenna consisting of the nonreciprocal CRLH transmission line has become able to control the radiation angle, and this leads to that the phase constant differs between the traveling wave and the reflected wave propagating in the resonator. Consequently, the frequency dispersion characteristic of the nonreciprocal phase shift amount obtained from the average value of the phase constant in the case of forward travel and the phase constant in the case of backward travel causes beam squint. There has been proposed no method for substantially preventing the occurrence of the beam squint until now, and no effective means is found.

An object of the present invention is to solve the aforementioned problems, and provide a nonreciprocal transmission line apparatus that substantially prevents the beam squint from occurring in the vicinity of the center frequency of the operation band and an antenna apparatus having the nonreciprocal transmission line apparatus.

Means for Dissolving the Problems

According to the first aspect of the present invention, there is provided a nonreciprocal transmission line apparatus configured by connecting in cascade at least one unit cell. Each of the unit cell(s) includes: (a) a microwave transmission line section; (b) a series branch circuit equivalently including a capacitance element; and (c) first and second parallel branch circuits provided branched from the transmission line section, each of the first and second parallel branch circuit equivalently including an inductive element between first and second ports. A propagation constant in a forward direction and a propagation constant in a backward direction of the nonreciprocal transmission line apparatus are different from each other. The transmission line section of each unit cell has spontaneous magnetization so as to have gyro anisotropy by being magnetized in a direction different from a propagation direction of microwaves or by being externally magnetized by an external magnetic field. The first parallel branch circuit is a first stub conductor having a first electrical length, and the second parallel branch circuit is a second stub conductor having a second electrical length shorter than the first electrical length. When a phase constant in a first mode of propagation in the forward direction is $\beta_p$, and a phase constant in a second mode of propagation in the backward direction is $\beta_m$, the first and second electrical lengths are set so that a function of nonreciprocal phase shift amount $\beta_{NR}=(\beta_p-\beta_m)/2$ with respect to the operating angular frequency comes close to a function of nonreciprocal phase shift amount $\beta_{NRZ}$ with respect to an operating angular frequency, when beam squint of such a phenomenon that a radiation direction of electromagnetic waves radiated from the nonreciprocal transmission line apparatus changes in accordance with frequency does not occur in the vicinity of an intersection of a dispersion curve representing a relation between the phase constant $\beta_p$ and the operating angular frequency and a dispersion curve representing a relation between the phase constant $\beta_m$, and the operating angular frequency.

In the nonreciprocal transmission line apparatus of the first aspect of the present invention, the function is a function proportional to the operating angular frequency.

In addition, in the nonreciprocal transmission line apparatus of the first aspect of the present invention, the first stub conductor has a first admittance, the second stub conductor has a second admittance, and the first and second electrical lengths are set such that: (a) the first admittance substantially coincides with the second admittance at a predetermined operating angular frequency lower than the operating angular frequency at the intersection, and (b) respective imaginary parts of the first and second admittances are negative at the predetermined operating angular frequency.

Further, in the nonreciprocal transmission line apparatus of the first aspect of the present invention, the first stub conductor is a short-circuit stub, and the first electrical length is set to be longer than one-half of a guide wavelength. The second stub conductor is a short-circuit stub, and the second electrical length is set to be shorter than one-fourth of the guide wavelength.

Furthermore, in the nonreciprocal transmission line apparatus of the first aspect of the present invention, the first stub conductor is an open stub, and the first electrical length is set to be longer than one-fourth of a guide wavelength. The second stub conductor is a short-circuit stub, and the second electrical length is set to be shorter than one-fourth of the guide wavelength.

Furthermore, the nonreciprocal transmission line apparatus of the first aspect of the present invention further includes a grounding conductor provided between the first stub conductors, and the grounding conductor provides a shield between the first stub conductors.

According to the second aspect of the present invention, there is provided an antenna apparatus including the nonreciprocal transmission line apparatus of the first aspect of the present invention.

Advantageous Effects of the Invention

According to the nonreciprocal transmission line apparatus and the antenna apparatus of the present invention, the function of the nonreciprocal phase shift amount $\beta_{NR}=(\beta_p-\beta_m)/2$ with respect to the operating angular frequency is configured so as to come close to the function of the nonreciprocal phase shift amount $\beta_{NR}$ with respect to the operating angular frequency when the beam squint of such a phenomenon that the radiation direction of electromagnetic waves radiated from the nonreciprocal transmission line apparatus changes in accordance with the frequency does not occur. Therefore, any beam squint does not substantially occur in the vicinity of the center frequency of the operation band.

BEST MODE FOR CARRYING OUT THE INVENTION

Figure 1:
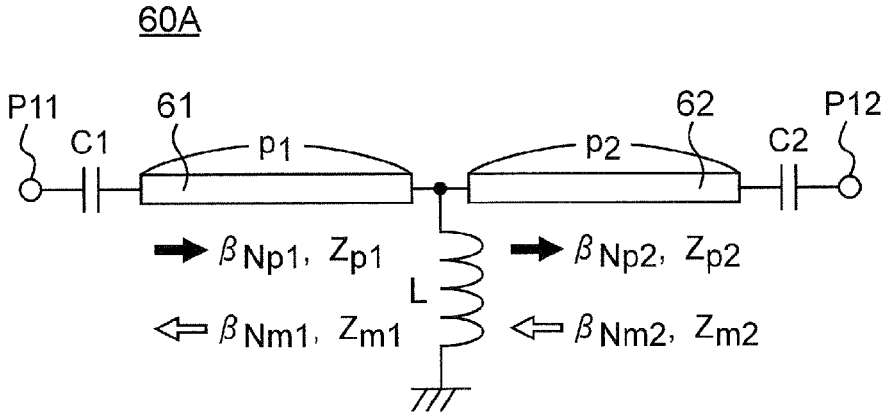
FIG. 1 is an equivalent circuit diagram of a unit cell 60A of a transmission line of a first example in a nonreciprocal transmission line apparatus according to an embodiment of the present invention.

Embodiments of the present invention will be described below with reference to the drawings. In the following embodiments, like components are denoted by the same reference signs.

First of all, a fundamental configuration and an operation principle of the nonreciprocal transmission line apparatuses 70A to 70F according to the present invention are described below with reference to FIGS. 1 to 12. Mathematical expressions indicated in the present specification are respectively identified by parenthesized numbers each positioned after a mathematical expression.

A nonreciprocal transmission line apparatus according to an embodiment of the present invention is configured by connecting in cascade a plurality of unit cells of a transmission line. FIGS. 1 to 4 are equivalent circuit diagrams of unit cells 60A to 60D of exemplary transmission lines, each used as a nonreciprocal transmission line apparatus according to a first embodiment of the present invention. Each of the unit cells 60A to 60D is configured to include a transmission line part having a nonreciprocal phase shift characteristic of forward and backward propagation constants different from each other, and is configured such that a capacitive element is equivalently inserted in a series branch circuit and an inductive element is equivalently inserted in a shunt branch circuit (See FIGS. 1 to 4). The circuit or apparatus, to which the configuration of the nonreciprocal transmission line apparatus according to the present invention can be applied, includes: printed board circuits, waveguides, and dielectric lines for use in microwave, millimeter wave, sub-millimeter wave, or terahertz wave, such as strip lines, microstrip lines, slot lines, and coplanar lines; and further includes: all sorts of configurations supporting a waveguide mode or an evanescent mode, including plasmon, polariton, magnon, or the like; combinations thereof; and free spaces capable of being considered as their equivalent circuit. Electromagnetic waves transmitted by the nonreciprocal transmission line apparatus include microwaves, millimeter waves, quasi-millimeter waves, and terahertz waves in the frequency bands of the UHF (Ultra High Frequency) band or higher, and in the present specification, these electromagnetic waves are collectively referred to as a "microwave".

The transmission line having the nonreciprocal phase shift characteristics is configured by including such a transmission line among the aforementioned transmission lines that is configured to particularly include gyrotropic materials in part or as a whole, and to be magnetized in a magnetization direction different from a propagation direction of the electromagnetic wave (more preferably, in a direction orthogonal to the propagation direction) to be asymmetric with respect to a plane composed of the propagation direction and the magnetization direction. In addition to such a transmission line, a lumped-parameter element, having an equivalent nonreciprocal phase shift feature and being sufficiently small as compared to a wavelength, is also available as a transmission line having the nonreciprocal phase shift characteristics. The gyrotropic materials include all such materials that a dielectric constant tensor, a permeability tensor, or both of them exhibits gyrotropy, due to spontaneous magnetization, magnetization produced by an externally supplied DC or low-frequency magnetic field, or an orbiting free charge. Exemplary and specific gyrotropic materials include: ferrimagnetic materials such as ferrite, ferromagnetic materials, solid-state plasma (semiconductor materials etc.), liquid and gaseous plasma media, and magnetic artificial media made by micromachining or the like, for use in microwave, millimeter wave, and so on.

The capacitive element inserted in the series branch circuit may include a capacitor commonly used in electric circuits, a distributed-parameter capacitance element for microwave, millimeter wave, etc., and may include equivalent circuits or circuit elements having a negative effective permeability for the electromagnetic wave mode of propagation through the transmission line. In order to obtain the negative effective permeability, the series branch circuit should be equivalent to a transmission line dominantly operating as a capacitive element. Concrete examples of elements having the negative effective permeability include: a split ring resonator made of metal; a spatial arrangement including at least one magnetic resonator of a spiral structure; a spatial arrangement of a magnetically resonating dielectric resonator; or a microwave circuit operable in the waveguide mode or the evanescent mode having the negative effective permeability, such as an edge mode propagation along a ferrite substrate microstrip line. In addition, the capacitive element inserted in the series branch circuit may be a series or parallel connection of capacitive elements and inductive elements, or a combination of their series and parallel connections. The element or circuit to which to be inserted may be capacitive as a whole.

The inductive element inserted in the shunt branch circuit may include a lumped-parameter element such as a coil used in electrical circuits, and a distributed-parameter inductive element such as a short-circuit stub conductor for microwave, millimeter wave, etc., and may include a circuit or an element having a negative effective dielectric constant for the electromagnetic wave mode of propagation through the transmission line. In order to obtain the negative effective dielectric constant, the shunt branch circuit should be equivalent to a transmission line dominantly operating as an inductive element. Concrete examples of elements having the negative effective dielectric constant include: a spatial arrangement including at least one electric resonator of a metal thin wire, a metal sphere, etc.; a spatial arrangement of an electrically resonating dielectric resonator other than metal; or a microwave circuit operable in a waveguide mode or an evanescent mode having the negative effective dielectric constant, such as waveguides and parallel planar lines, in which the TE mode is in a blocking region. In addition, the inductive element inserted in the shunt branch circuit may be a series or parallel connection of capacitive elements and inductive elements, or a combination of their series and parallel connections. The element or circuit to which to be inserted may be inductive as a whole.

The evanescent mode may occur in the transmission line apparatus having the nonreciprocal phase shift characteristics, when the transmission line apparatus has the negative effective permeability for the electromagnetic wave mode of propagation through the transmission line apparatus. Since the negative effective permeability corresponds to a case where a capacitive element is inserted in the series branch circuit, the equivalent circuit of the transmission line apparatus includes both the nonreciprocal phase shift part and the series capacitive element part.

The evanescent mode may occur in the transmission line apparatus having the nonreciprocal phase shift characteristics, when the transmission line apparatus has the negative effective dielectric constant for the electromagnetic wave mode of propagation through the transmission line apparatus. Since the negative effective dielectric constant corresponds to a case where an inductive element is inserted in the shunt branch circuit, the equivalent circuit of the transmission line apparatus includes both the nonreciprocal phase shift part and the shunt inductive element part.

Figure 2:
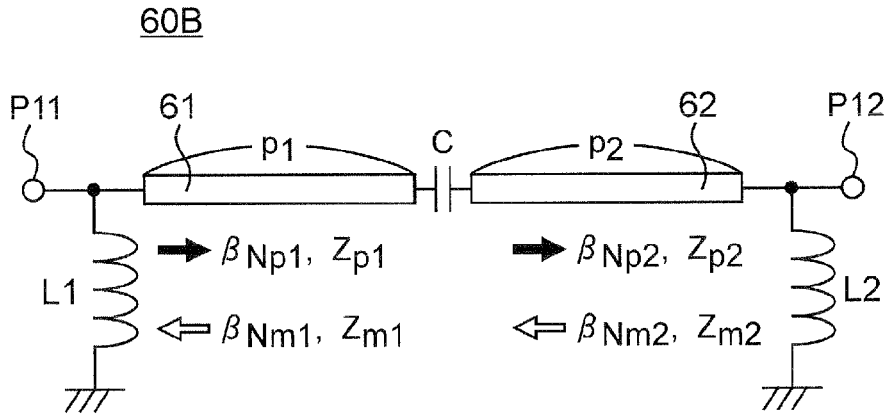
FIG. 2 is an equivalent circuit diagram of a unit cell 60B of a transmission line of a second example in a nonreciprocal transmission line apparatus according to an embodiment of the present invention.
Figure 3:
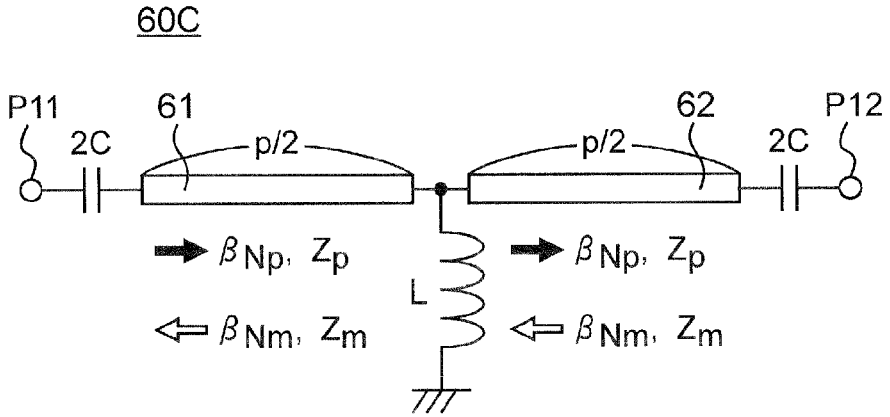
FIG. 3 is an equivalent circuit diagram of a unit cell 60C of a transmission line of a third example in a nonreciprocal transmission line apparatus according to an embodiment of the present invention.
Figure 4:
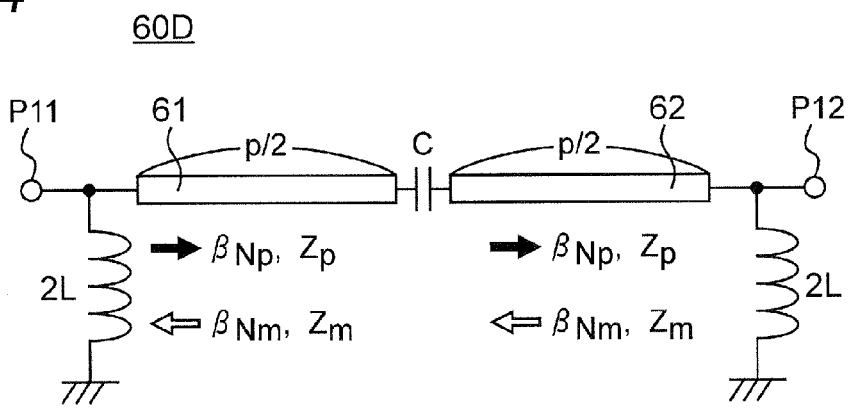
FIG. 4 is an equivalent circuit diagram of a unit cell 60D of a transmission line of a fourth example in a nonreciprocal transmission line apparatus according to an embodiment of the present invention.

FIGS. 1 and 2 show cases where the unit cells 60A and 60B have an asymmetric T-structure and an asymmetric π-structure, respectively. FIGS. 3 and 4 show more simple cases where the unit cells 60C and 60D have a symmetric T-structure and a symmetric π-structure, respectively. Hereinafter, it is assumed in principle that the transmission line length of the unit cells 60A to 60D (i.e., the period length p=p1+p2) is sufficiently small with respect to the wavelength. Therefore, essentially the same result will be obtained for any of the T-structure, the π-structure, or L-structure, in a manner similar to that of the case of unit cells of a transmission line in the conventional composite right/left-handed transmission line apparatus. In fact, the L-structure falls under the case of FIG. 1 or 2 with parameters being set appropriately. It is emphasized that the transmission line length of each of the unit cells 60A to 60D with respect to the wavelength does not restrict the fundamental operation described here.

FIGS. 1 to 4 show simple line structures, where a transmission line includes two transmission line parts 61 and 62 having predetermined line lengths (the transmission line lengths of FIGS. 1 and 2 are p1 and p2, respectively, and each of the transmission line lengths of FIGS. 3 and 4 is p/2), a capacitive element or a capacitive circuit network is inserted in the series branch circuit of the transmission line, and an inductive element or an inductive circuit network is inserted in the shunt branch circuit of the transmission line. FIG. 1 shows capacitors C1 and C2 and an inductor L inserted in the transmission line, in order to simply and collectively represent the effective values of these elements. Similarly, FIG. 2 shows a capacitor C and inductors L1 and L2 inserted in the transmission line. Each of the transmission line parts 61 and 62 is configured to have a nonreciprocal phase shift characteristic of different forward and backward propagation constants. When considering the propagation constants in the present specification, the imaginary part of the propagation constants, i.e., the phase constant is used. As parameters indicative of the nonreciprocity of the transmission line part 61, $\beta_{Np1}$ and $Z_{p1}$ denote a forward phase constant and a forward characteristic impedance ("forward" means a direction from a port P11 to a port P12), respectively, and $\beta_{Nm1}$ and $Z_{m1}$ denote a backward phase constant and a backward characteristic impedance ("backward" means a direction from the port P12 to the port P11), respectively. Similarly, as parameters indicative of the nonreciprocity of the transmission line part 62, $\beta_{Np2}$ and $Z_{p2}$ denote a forward phase constant and a forward characteristic impedance, respectively, and $\beta_{Nm2}$ and $Z_{m2}$ denote a backward phase constant and a backward characteristic impedance, respectively. Each of the transmission lines of FIGS. 1 and 2 has asymmetric transmission line parts 61 and 62. On the other hand, each of the transmission lines of FIGS. 3 and 4 has symmetric transmission line parts 61 and 62, and satisfies: p1=p2=p/2, $\beta_{Np1}=\beta_{Np2}=\beta_{Np}$, $\beta_{Nm1}=\beta_{Nm2}=\beta_{Nm}$, $Z_{p1}=Z_{p2}=Z_p$, $Z_{m1}=Z_{m2}=Z_m$. In addition, a transmission line of T-structure satisfy C1=C2=C, and a transmission line of π-structure satisfy L1=L2=L. Specifically, by imposing periodic boundary conditions to both ends of the unit cells 60A to 60D of the transmission lines of FIGS. 3 and 4, the following equation is obtained:

$$\cos\left[\left(\beta-\frac{\Delta\beta}{2}\right)-p\right]=\left(1-\frac{1}{\omega^2\cdot L\cdot C}\cdot\frac{Z_p\cdot Z_m}{(Z_p+Z_m)^2}\right)\cdot\cos(\bar{\beta}\cdot p)+\frac{1}{Z_p+Z_m}\left(\frac{Z_p\cdot Z_m}{\omega\cdot L}+\frac{1}{\omega\cdot C}\right)\cdot\sin(\bar{\beta}\cdot p)-\frac{1}{2\cdot\omega^2\cdot L\cdot C}\cdot\frac{Z_p^2+Z_m^2}{(Z_p+Z_m)^2} \quad (1)$$

$\Delta\beta$ and $\bar{\beta}$ are given as follows:

$$\Delta\beta=\beta_{Np}-\beta_{Nm},\text{ and}$$

$$\bar{\beta}=\frac{\beta_{Np}+\beta_{Nm}}{2},$$

where ω denotes an operating angular frequency, and β denotes a phase constant of an electromagnetic wave propagating along a periodic structure. The Equation (1) denotes a relation between the operating angular frequency ω and the phase constant β, and therefore, it is an equation of dispersion (ω-β diagram).

Assuming the reciprocal characteristic ($\beta_{Np}=\beta_{Nm}$, and $Z_p=Z_m$) in the Equation (1), the transmission line becomes the same as the conventional reciprocal transmission line apparatus, and the Equation (1) is simplified as follows:

$$\cos(\beta\cdot p)=\cos(\beta_{Np}\cdot p)-\frac{1}{2\cdot\omega^2\cdot L\cdot C}\cdot\cos^2\left(\frac{\beta_{Np}\cdot p}{2}\right)+\frac{j}{2}\cdot\left(\frac{Y}{Y_p}+\frac{Z}{Z_p}\right)\cdot\sin(\beta_{Np}\cdot p). \quad (2)$$

It is assumed that in the Equation (2), the admittance Y=1/jωL, and the impedance Z=1/jωC.

Figure 5:
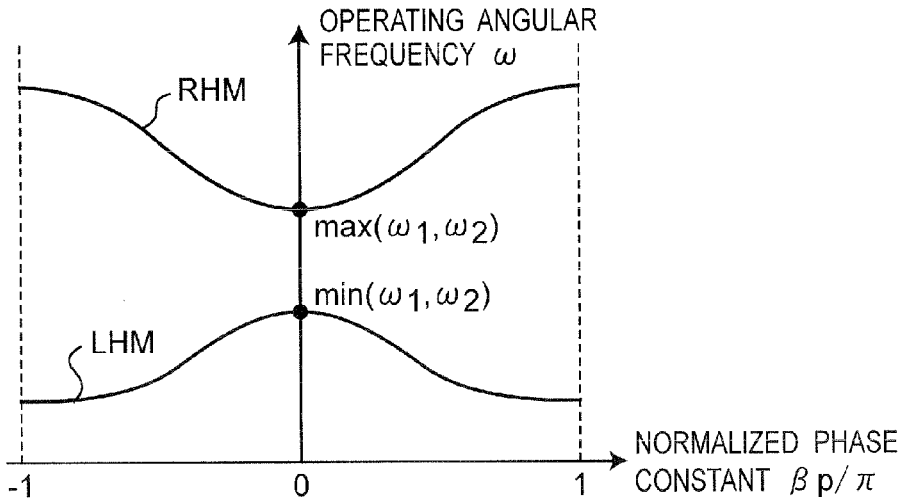
FIG. 5 is a graph showing dispersion curves in the case of an unbalanced state in a prior art reciprocal transmission line apparatus.
Figure 6:
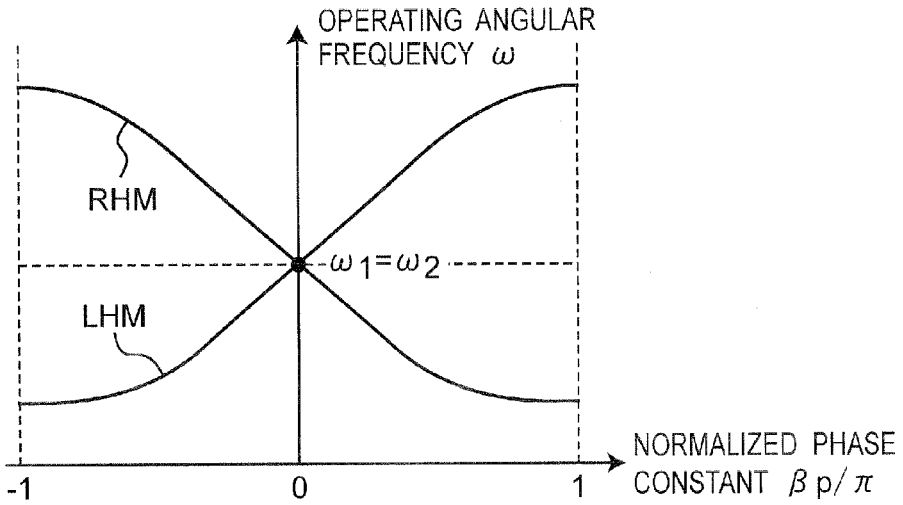
FIG. 6 is a graph showing dispersion curves in the case of a balanced state in a prior art reciprocal transmission line apparatus.

FIG. 5 is a graph showing dispersion curves of a conventional reciprocal transmission line apparatus in an unbalanced state. FIG. 6 is a graph showing dispersion curves of the conventional reciprocal transmission line apparatus in a balanced state. The graphs of FIGS. 5 and 6 indicate characteristics of an angular frequency ω versus a normalized phase constant β·p/π FIG. 5 shows typical dispersion curves in the case of the conventional transmission line apparatus denoted by the Equation (2), and in general, a forbidden band appears between a band with the right-handed (RH) transmission characteristic and a band with the left-handed (LH) transmission characteristic. Frequencies at the upper limit of the left-handed transmission band at the lower limit of the right-handed transmission band are obtained as the solutions of a quadratic equation of the angular frequency $\omega^2$, by imposing the condition of the phase constant β=0 on the Equation (2). As a result, the following two solutions are obtained:

$$\omega_1 = \sqrt{\frac{1}{L \cdot \varepsilon_p \cdot p}}, \text{ and} \tag{3}$$

$$\omega_2 = \sqrt{\frac{1}{C \cdot \mu_p \cdot p}}, \tag{4}$$

where $\epsilon_p$ and $\mu_p$ denote an effective dielectric constant and an effective permeability of the transmission line parts 61 and 62 in the unit cells 60A to 60D. Therefore, in order for the cutoff frequencies to satisfy $\omega_1=\omega_2$ with no forbidden band, it is only necessary for the Equation (2) to have a multiple root under the condition of the phase constant β=0, and as a result, the following equation is obtained:

$$Z_p = \sqrt{\frac{\mu_p}{\varepsilon_p}} = \sqrt{\frac{L}{C}}. \tag{5}$$

According to the results of the Equation (5), no gap appears if an impedance $\sqrt{L/C}$ of the capacitor C and the inductor L is identical to the characteristic impedances $Z_p$ of the transmission line parts 61 and 62, where the capacitor C is a capacitive element inserted in the series branch circuit, and the inductor L is an inductive element inserted in the shunt branch circuit. The Equation (5) is a kind of condition for impedance matching. FIG. 6 shows dispersion curves of that case.

The dispersion curves of the nonreciprocal transmission line apparatus given by the Equation (1) is described below. In the case of the reciprocal transmission line, it is shown according to the Equation (2) that the dispersion curves are symmetric with respect to the axis of the phase constant β=0 (i.e., ω axis). On the other hand, in the case of the nonreciprocal transmission line apparatus, it is readily shown according to the left side of the Equation (1) that the axis of symmetry of the dispersion curves is shifted with respect to β in the positive direction from the axis of β=0 by the following equation:

$$\beta_{NR} = \frac{\Delta\beta}{2} = \frac{\beta_{Np} - \beta_{Nm}}{2}. \tag{6}$$

$\beta_{NR}$ is referred to as a nonreciprocal shift amount hereinafter. As a result, FIG. 7 is obtained corresponding to FIG. 5.

Figure 7:
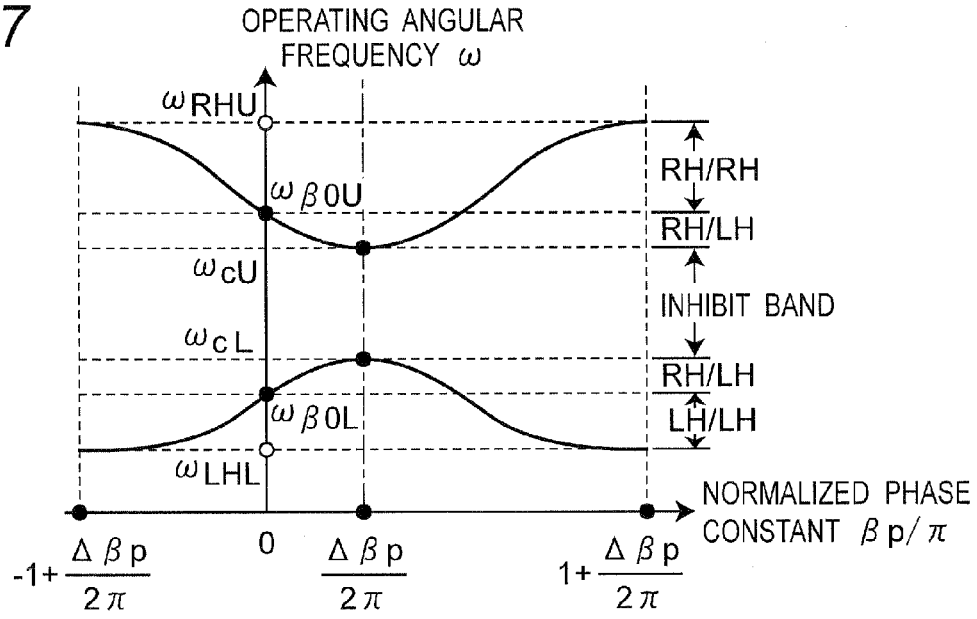
FIG. 7 is a graph showing dispersion curves in the case of an unbalanced state in a nonreciprocal transmission line apparatus according to an embodiment.
Figure 8:
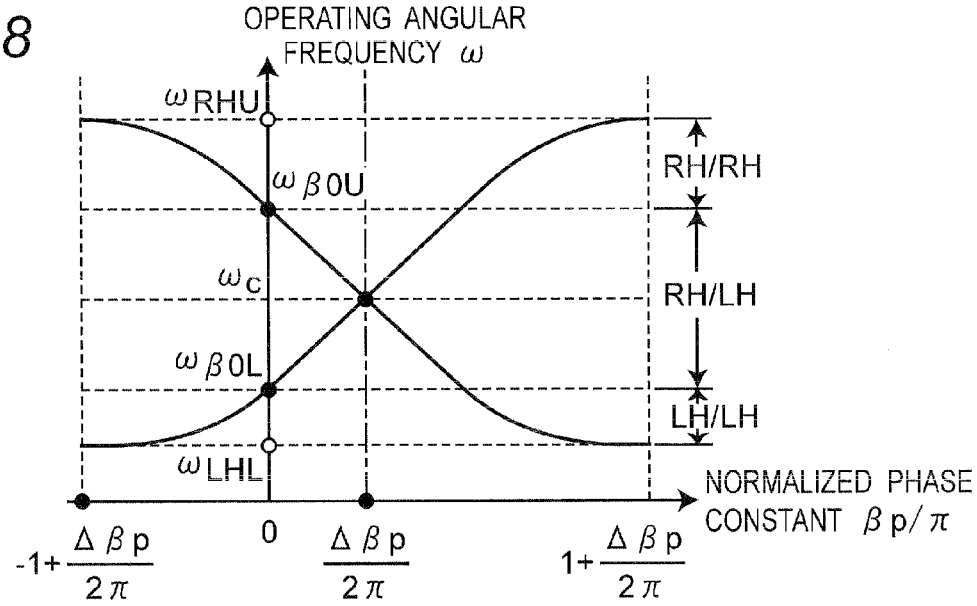
FIG. 8 is a graph showing dispersion curves in the case of a balanced state in a nonreciprocal transmission line apparatus according to an embodiment.

FIG. 7 is a graph showing dispersion curves of a nonreciprocal transmission line apparatus according to the embodiment in an unbalanced state. FIG. 8 is a graph showing dispersion curves of the nonreciprocal transmission line apparatus according to the embodiment in a balanced state.

As described above, the nonreciprocal transmission line apparatus is significantly different from the reciprocal transmission line apparatus such that the axis of symmetry of the dispersion curves is shifted from the ω axis in the right or left direction, because the phase constant $\beta=\beta_p$ in the forward direction and the phase constant $\beta=\beta_m$ satisfy $\beta_m \neq \beta_p$ (therefore, the forward and backward propagation constants are different from each other), i.e., because of the effect of a nonreciprocal phase shift. It is to be noted that the nonreciprocal shift amount $\beta_{NR}$ can be represented by the following equation, using the phase constant $\beta_p$ in the forward direction and the phase constant $\beta_m$ in the backward direction instead of the Equation (6):

$$\beta_{NR} = \frac{\Delta\beta}{2} = \frac{\beta_p - \beta_m}{2}.$$

As a result, the transmission bands are classified into the following five transmission bands (A) to (E).

(A) Both the forward and backward propagations are done as a left-handed transmission. The magnitudes of the propagation constants are different from each other.

(B) The forward propagation is done as a left-handed transmission, and the backward propagation has zero propagation constant and infinite guide wavelength.

(C) The forward propagation is done as a left-handed transmission, and the backward propagation is done as the right-handed transmission.

(D) The forward propagation is done as a right-handed transmission, and the backward propagation has zero propagation constant and infinite guide wavelength.

(E) Both the forward and backward propagations are done as a right-handed transmission. The magnitudes of the propagation constants are different from each other.

In general, a stop band (forbidden band) appears at the center of the transmission band (C) as shown from FIG. 7. In particular, when using the transmission band indicated by RH/LH of FIGS. 7 and 8, there is such an advantageous feature that even if supplying microwave signals to both the ports in both directions (the forward and backward directions), the flows of phases have an identical direction in the left-handed transmission and right-handed transmission.

Considering the conventional reciprocal transmission line for the purpose of comparison, the two identical modes with positive and negative directions of the power transmission intersect each other without coupling between these two modes, when the matching condition of the Equation (5) is satisfied, i.e., when the phase constant β=0 as shown in FIG. 6. Similarly, on the axis of symmetry $\beta=\Delta\beta/2=\beta_{NR}$ of the dispersion curves of the Equation (1), the Equation (1) is a quadratic equation with respect to the angular frequency $\omega^2$. By imposing a condition of a multiple root in order to avoid a band-gap, the following equation is obtained:

$$Z_p = \sqrt{\frac{\mu_p}{\varepsilon_p}} = \sqrt{\frac{L}{C}}, \tag{7}$$

or $$Z_m = \sqrt{\frac{\mu_m}{\varepsilon_m}} = \sqrt{\frac{L}{C}},$$

where $\epsilon_p$ and $\mu_p$ denote a forward effective dielectric constant and a forward effective permeability of the nonreciprocal transmission line parts 61 and 62 in the unit cells 60A to 60D, and $\epsilon_m$ and $\mu_m$ denote their backward effective dielectric constants and backward effective permeabilities. According to the Equation (7), the condition for avoiding a gap near the intersection of the two modes is a condition for impedance matching, in a manner similar to that of the case of the Equation (5) of the reciprocal transmission line apparatus. In addition, it is only necessary to insert an inductor L and a capacitor C so that matching is made in either the forward direction or the backward direction, and there is an advantageous feature that a weaker condition of impedance matching is imposed than in the case of the reciprocal transmission line apparatus.

A more general case of two asymmetric transmission line parts 61 and 62 as shown in FIGS. 1 and 2 is described below. Even in such an asymmetric case, its fundamental operation depends on dispersion curves similar to those shown in FIGS. 7 and 8. The position of the axis of symmetry is modified as follows on the normalized phase constant $\beta \cdot p/\pi$ of the horizontal axes of FIGS. 7 and 8:

$$\frac{\beta \cdot p}{\pi} = \frac{(\beta_{Np1} - \beta_{Nm1}) \cdot p_1}{2\pi} + \frac{(\beta_{Np2} - \beta_{Nm2}) \cdot p_2}{2\pi}.$$

Moreover, when the two nonreciprocal transmission line parts 61 and 62 have an identical propagation characteristic, a matching condition for avoiding a band-gap is the same as that of the Equation (7). It is noted that the condition of FIG. 1 is as follows:

$$\frac{1}{C} = \frac{1}{C1} + \frac{1}{C2},$$

and the condition of FIG. 2 is as follows:

$$\frac{1}{L} = \frac{1}{L1} + \frac{1}{L2}.$$

Figure 9:
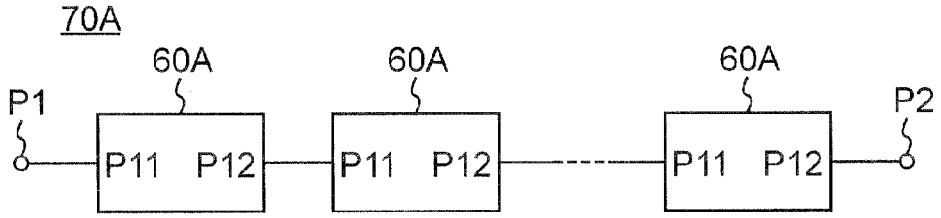
FIG. 9 is a block diagram showing a configuration of a nonreciprocal transmission line apparatus 70A configured by connecting in cascade the unit cells 60A of FIG. 1.
Figure 10:
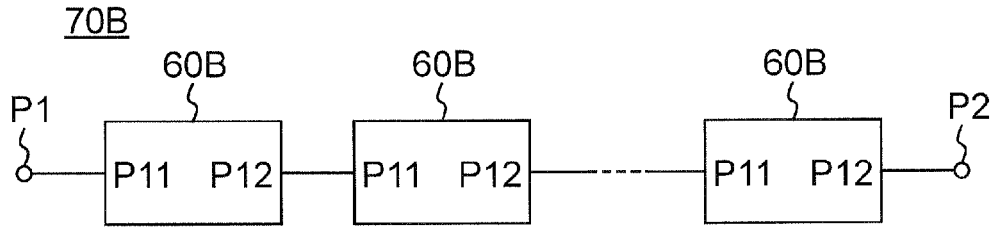
FIG. 10 is a block diagram showing a configuration of a nonreciprocal transmission line apparatus 70B configured by connecting in cascade the unit cells 60B of FIG. 2.
Figure 11:
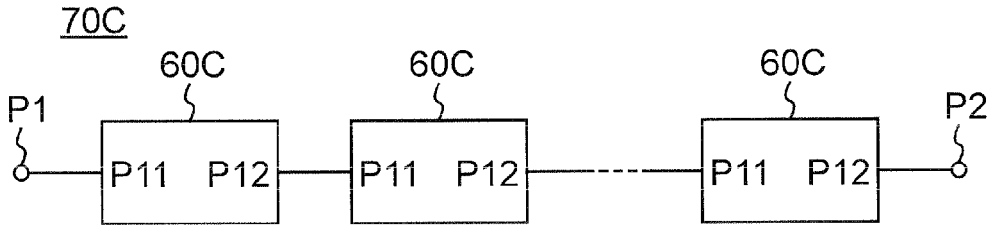
FIG. 11 is a block diagram showing a configuration of a nonreciprocal transmission line apparatus 70C configured by connecting in cascade the unit cells 60C of FIG. 3.
Figure 12:
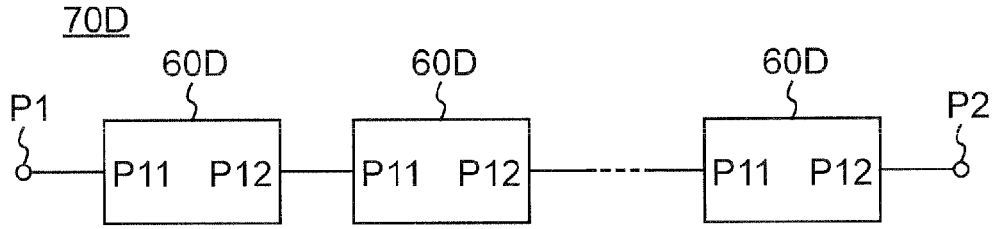
FIG. 12 is a block diagram showing a configuration of a nonreciprocal transmission line apparatus 70D configured by connecting in cascade the unit cells 60D of FIG. 4.

Referring to FIGS. 9 to 12, an entire nonreciprocal transmission line apparatus according to an embodiment of the present invention is configured by including at least one or more of the plurality of unit cells 60A to 60D of FIGS. 1 to 4, and by connecting them in cascade. FIG. 9 is a block diagram showing a configuration of a nonreciprocal transmission line apparatus 70A including a cascade connection of a plurality of the unit cells 60A of FIG. 1. Referring to FIG. 9, the nonreciprocal transmission line apparatus 70A is configured by connecting in cascade the plurality of unit cells 60A between the port P1 and the port P2. FIG. 10 is a block diagram showing a configuration of a nonreciprocal transmission line apparatus 70B including a cascade connection of a plurality of the unit cells 60B of FIG. 2. Referring to FIG. 10, the nonreciprocal transmission line apparatus 70B is configured by connecting in cascade the plurality of unit cells 60B between the port P1 and the port P2. FIG. 11 is a block diagram showing a configuration of a nonreciprocal transmission line apparatus 70C including a cascade connection of a plurality of the unit cells 60C of FIG. 3. Referring to FIG. 11, the nonreciprocal transmission line apparatus 70C is configured by connecting in cascade the plurality of unit cells 60C between the port P1 and the port P2. FIG. 12 is a block diagram showing a configuration of a nonreciprocal transmission line apparatus 70D including a cascade connection of a plurality of the unit cells 60D of FIG. 4. Referring to FIG. 12, the nonreciprocal transmission line apparatus 70D is configured by connecting in cascade the plurality of unit cells 60D between the port P1 and the port P2. Even when cascade connecting a plurality of unit cells 60A to 60D, it is not necessary to configure the nonreciprocal transmission line apparatus from only one type of the unit cells 60A to 60D, and it is possible to cascade connect a combination of different types of the unit cells 60A to 60D.

Hereinafter, the dispersion curves of the nonreciprocal transmission line apparatuses 70A to 70F according to the present embodiment and the following embodiments are dispersion curves in the balanced state as shown in FIG. 8. Moreover, in the dispersion curves of FIG. 8, the operating angular frequency $\omega$ at the intersection where two modes intersect each other is defined as the center angular frequency $\omega_C$, and the nonreciprocal phase shift amount $\beta_{NR}$ at the intersection is defined as a nonreciprocal phase shift amount $\beta_{NRC}$. It is also operable in the case of the dispersion curves in an unbalanced state where a band-gap exists as shown in FIG. 7. In this case, the angular frequency corresponding to the center operating angular frequency $\omega_C$ in FIG. 8, which also depends on the transmission line terminal conditions on both sides of the transmission line, corresponds to two angular frequencies $\omega c_U$ and $\omega c_L$ corresponding to the band-gap ends of the dispersion curves of FIG. 7 or inside the band-gap between them.

When the nonreciprocal transmission line apparatus 70A to 70F are formed on a dielectric substrate, the derivative of an angle $\theta$ (hereinafter, referred to as a radiation angle $\theta$) between the beam direction of the pseudo traveling wave resonator antenna apparatus having the nonreciprocal transmission line apparatus 70A to 70F and the direction perpendicular to the dielectric substrate with respect to of the operating angular frequency $\omega$ is expressed by the following equation in the vicinity of the center angular frequency $\omega_C$ (See Non-Patent Document 1):

$$\frac{d\theta}{d\omega} \cong \frac{1}{\sqrt{\beta_0^2 - \beta_{NRC}^2}} \left( \frac{d\beta_{NR}}{d\omega}\bigg|_{\omega=\omega_C} - \frac{\beta_{NRC}}{\omega_C} \right) \tag{8}$$

where $\beta_0$ denotes a phase constant of electromagnetic waves in vacuum. Therefore, in order to prevent the beam squint of such a phenomenon that the radiation angle $\theta$ of the electromagnetic waves radiated from the nonreciprocal transmission line apparatuses 70A to 70B changes in accordance with the operating frequency from occurring in the vicinity of the center angular frequency $\omega_C$ in the pseudo traveling wave resonator antenna apparatus having the nonreciprocal transmission line apparatus 70A to 70F, the following equation is only required to hold:

$$\beta_{NRC} = \frac{d\beta_{NR}}{d\omega}\bigg|_{\omega=\omega_C} \times \omega \tag{9}$$

That is, the nonreciprocal phase shift amount $\beta_{NR}$ is required to be proportional to the operating angular frequency $\omega$ in the vicinity of the center angular frequency $\omega_C$. The nonreciprocal transmission line apparatuses 70A to 70F of the present embodiment and the following embodiments are configured so as to satisfy the Equation (9), and this leads to that the occurrence of the beam squint can be prevented.

Figure 13A:
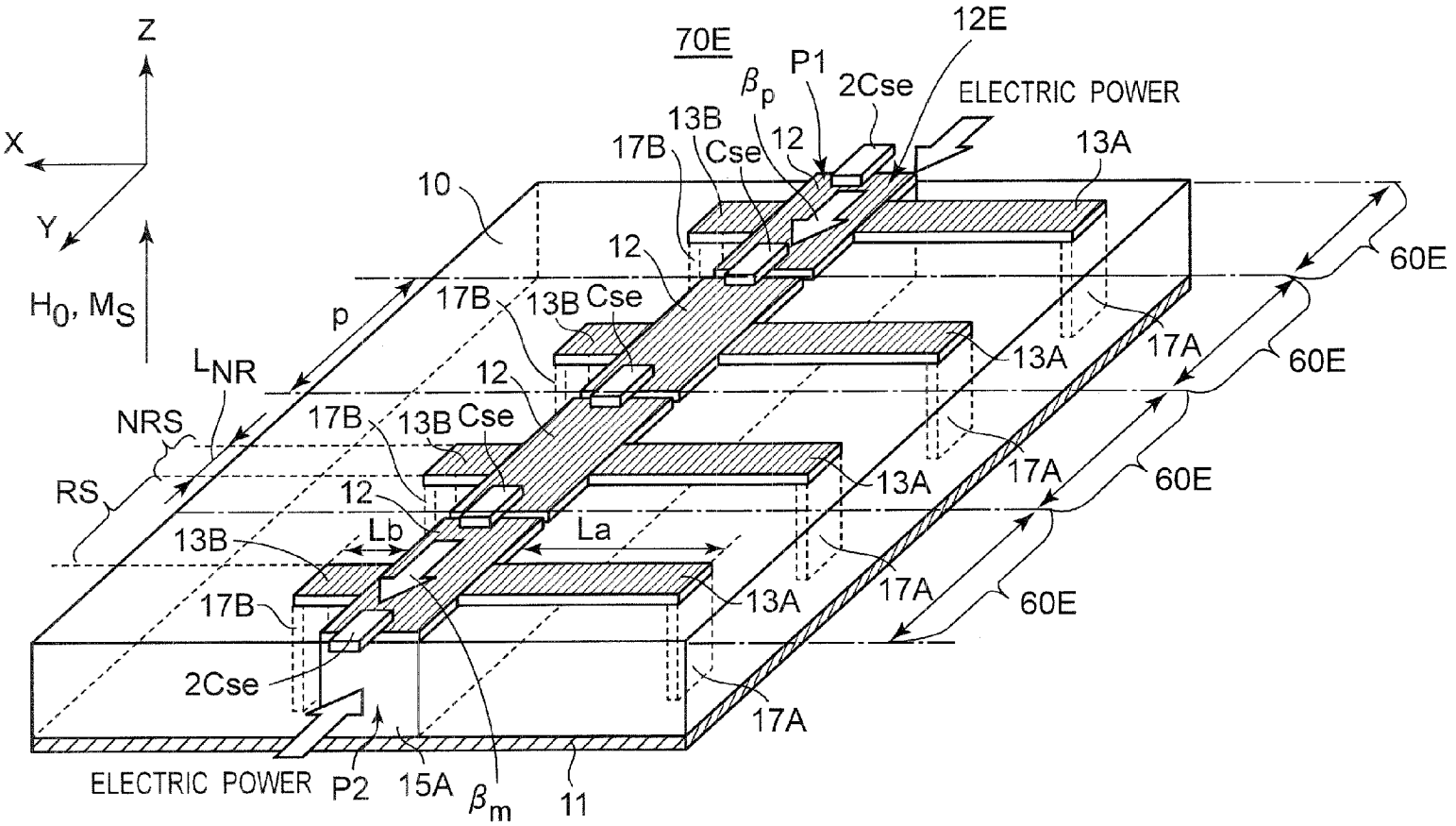
FIG. 13A is a perspective view showing a configuration of a nonreciprocal transmission line apparatus 70E according to an embodiment of the present invention.

FIG. 13A is a perspective view showing a configuration of a nonreciprocal transmission line apparatus 70E according to an embodiment of the present invention. The XYZ coordinates shown in FIG. 13A are referred to for the sake of explanation. Referring to FIG. 13A, the nonreciprocal transmission line apparatus 70E is configured to include a grounding conductor 11 provided parallel to the XY plane, a ferrite square bar (ferrite rod) 15A extending along the Y axis on the grounding conductor 11, a dielectric substrate 10 provided on both the +X and −X sides of the ferrite square bar 15A on the grounding conductor 11, a strip conductor 12, stub conductors 13A, stub conductors 13B, and capacitors Cse. Moreover, the ferrite square bar 15A, the strip conductor 12, the stub conductors 13A, the stub conductors 13B and the capacitors Cse configure a microstrip line 12E extending between ports P1 and P2 along the Y axis. A microwave signal is supplied from the port P1 or P2.

Figure 13B:
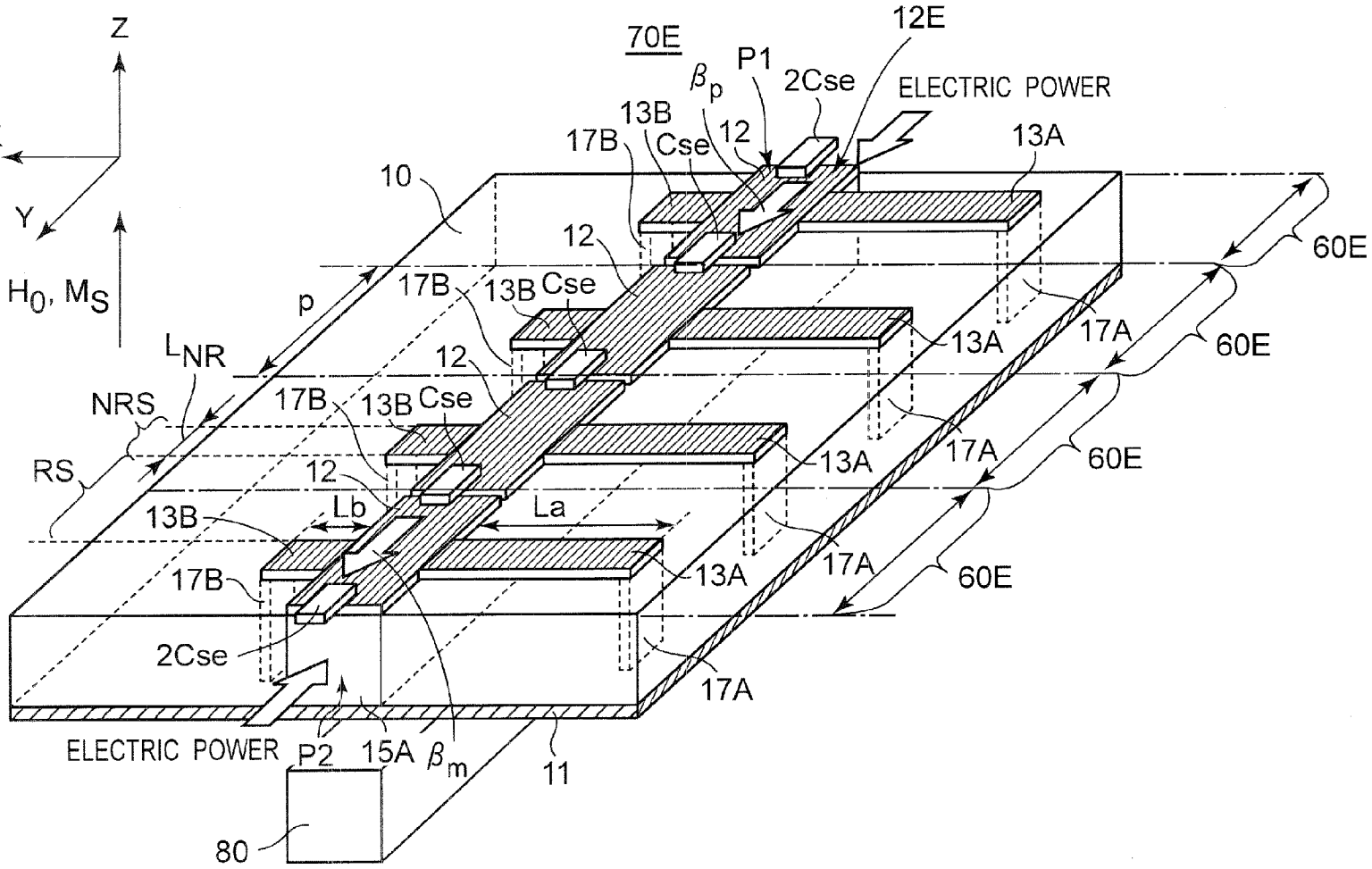
FIG. 13B is a perspective view showing a configuration of a nonreciprocal transmission line apparatus 70E according to a modified embodiment of the present invention.
Figure 22:
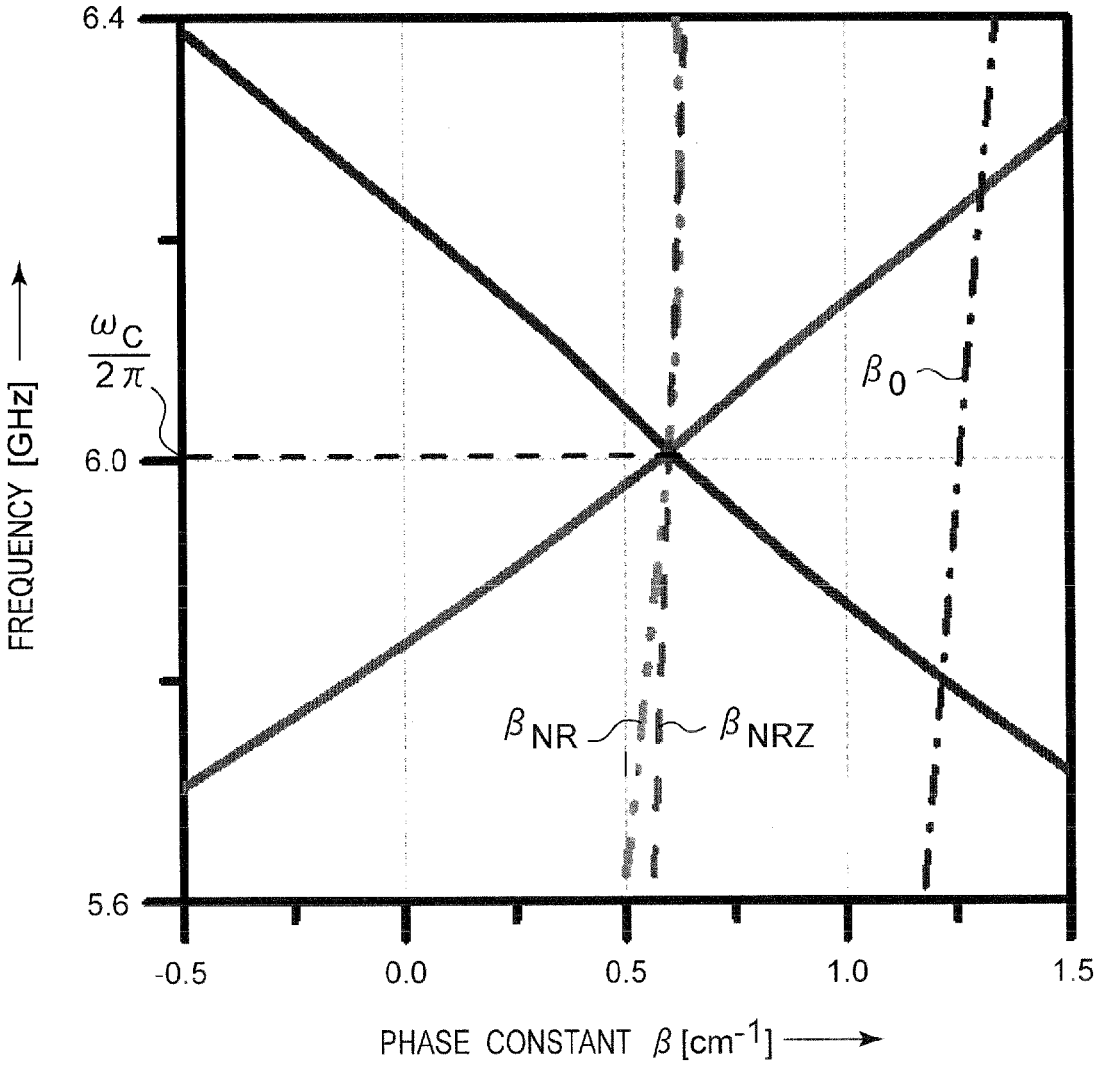
FIG. 22 is an enlarged view of FIG. 21.

The ferrite square bar 15A is magnetized in a magnetization direction different from the propagation direction of electromagnetic waves, and has spontaneous magnetization so as to have gyro anisotropy. In FIG. 22, the saturation magnetization $M_S$ and the internal magnetic field $H_0$ of the ferrite square bar 15A are indicated by arrows. In this case, the magnetization direction should be preferably a direction (e.g., +Z direction) orthogonal to the propagation direction (direction along the Y axis) of electromagnetic waves. It is acceptable to use a ferrite square bar having no spontaneous magnetization and apply a magnetic field by the external magnetic field generator 80 of FIG. 13B in place of the ferrite square bar 15A having a spontaneous magnetization.

Referring to FIG. 13A, the microstrip line 12E is configured by connecting in cascade the unit cells 60E of the transmission line having a period length p. One of the unit cells 60E is described. Each unit cell 60E is configured to include the strip conductor 12 extending along the Y axis on the ferrite square bar 15A, the capacitor Cse, and the stub conductors 13A and 13B. The capacitor Cse is connected to the end portion on the +Y side of the strip conductor 12, and the capacitor Cse is further connected to the strip conductor 12 of the unit cell 60E being ad adjacent to the +Y side of the unit cell 60A. Therefore, each capacitor Cse is inserted in series in the microstrip line 12E. Referring to FIG. 13A, capacitors, each having a capacitance 2Cse that is double one of the capacitor Cse forming between the strip conductors 12, are inserted at both ends of the microstrip line 12E.

The stub conductor 13A has an electrical length La, and extends on the −X side of the strip conductor 12. On the other hand, the stub conductor 13B has an electrical length Lb shorter than the electrical length La, and extends on the +X side of the strip conductor 12. The stub conductors 13A and 13B each diverge from the strip conductor 12, and are provided as two parallel branch circuits corresponding to the inductor L (parallel branch circuit) of FIG. 1. In detail, the stub conductor 13A extends in the −X direction along the X axis of the dielectric substrate 10, where its one end is connected to the strip conductor 12, and its other end is short-circuited (short-circuit stub) to the grounding conductor 11 via a grounding conductor 17A at the end portion on the −X side of the dielectric substrate 10. Likewise, the stub conductor 13B extends in the +X direction along the X axis on the dielectric substrate 10, where its one end is connected to the strip conductor 12, and its other end is short-circuited to the grounding conductor 11 via a grounding conductor 17B at the end portion on the +X side of the dielectric substrate 10.

As described above, the stub conductors 13A and 13B are formed on mutually different sides with respect to a plane (YZ plane) formed of the propagation direction (e.g., +Y direction or −Y direction which is indicated by an arrow on the microstrip line 12E of FIG. 13A) and the magnetization direction (e.g., +Z direction) of the microstrip line 12E. Each of the stub conductors 13A and 13B functions as an inductive element. The equivalent circuit of the unit cell 60E configured as mentioned above is similar to the equivalent circuit of the unit cell 60A of FIG. 1.

The nonreciprocal transmission line apparatus 70E of FIG. 13A is utilized for achieving a leaky wave antenna of resonance type. As described above, the nonreciprocal transmission line apparatus 70E is configured of the microstrip line 12E, which is provided between the ports P1 and P2, and in which the ferrite square bar 15A is embedded. Further, the stub conductors 13A and 13B of strip conductors, and the capacitor Cse are periodically inserted at an interval of a period length p in the microstrip line 12E. Since the major mode of the nonreciprocal transmission line apparatus 70E is the edge guide mode and the stub conductors 13A and 13B are asymmetrically inserted in the transmission line, the nonreciprocal transmission line apparatus 70E exhibits nonreciprocal transmission characteristics.

In concrete, when the impedances (i.e., electrical lengths) of the stub conductors 13A and 13B are made to be different from each other, the structure of the nonreciprocal transmission line apparatus 70E becomes asymmetrical with respect to the plane (YZ plane) formed of the propagation direction and the magnetization direction of the microstrip line 12E. Consequently, the propagation constant in the forward direction (direction from port P1 to P2) and the propagation constant in the backward direction (direction from port P2 to P1) are different from each other, so that a state of propagation in the right-handed mode in the forward direction and propagation in the left-handed mode in the backward direction can be achieved. According to this configuration, the magnitude of nonreciprocity can be changed by adjusting the electrical lengths La and Lb of the stub conductors 13A and 13B, respectively. As described in detail later, the electrical lengths La and Lb of the stub conductors 13A and 13B are set so that any beam squint does not substantially occur in the antenna apparatus using the nonreciprocal transmission line apparatus 70E.

The propagation characteristic in the TE mode of propagation along the microstrip line 12E, in which the ferrite square bar 15A is embedded, changes depending on the boundary conditions on the side surfaces on both sides of the microstrip line 12E. The inventor and others of the present application analyzed the general nonreciprocal dispersion characteristic of the nonreciprocal transmission line apparatus 70E. In the nonreciprocal CRLH leaky wave antenna of resonance type, the radiation angle θ can be evaluated from the expression of $\sin\theta=\beta_{NR}/\beta_0$ (See, for example, Non-Patent Document 1). In this case, $\beta_0$ denotes a phase constant in vacuum. Moreover, the nonreciprocal phase shift amount $\beta_{NR}$ is the average value of the phase constants $\beta_p$ and $\beta_m$ with respect to the two propagation directions, through which the electromagnetic power may flow in a manner similar to that of the Equation (6), and represents the magnitude of nonreciprocity of the phase constant β. In this case, the variation Δθ of the radiation angle θ due to a change in the operating angular frequency ω by Δω from the center angular frequency $\omega_C$ is approximately given by the following equation in Non-Patent Document 1:

$$\Delta\theta(\Delta\omega) = \frac{\Delta\omega}{\sqrt{\beta_0^2 - \beta_{NRC}^2}}\left(\frac{d\beta_{NR}}{d\omega}\bigg|_{\omega=\omega_C} - \frac{\beta_{NRC}}{\omega_C}\right). \tag{10}$$

Therefore, in order to prevent the beam squint from occurring in the vicinity of the center angular frequency $\omega_C$ in the nonreciprocal CRLH leaky wave antenna of resonance type having the nonreciprocal transmission line apparatus 70E, it is required that the nonreciprocal phase shift amount $\beta_{NR}$ is strictly proportional to the operating angular frequency co in the vicinity of the center angular frequency $\omega_C$.

Next, an approximate expression of the nonreciprocal phase shift amount $\beta_{NR}$ in the configuration of the nonreciprocal transmission line apparatus 70E of FIG. 13A is derived, and the conditions of the stub conductors 13A and 13B for substantially preventing the occurrence of the beam squint in the leaky wave antenna of resonance type using the nonreciprocal transmission line apparatus 70E are derived by an eigenmode analysis.

In the present embodiment, the nonreciprocal transmission line apparatus 70E is analyzed by combining the electromagnetic analysis with transmission line models. Referring to FIG. 13A, the nonreciprocal transmission line apparatus 70E is handled by being separated into a nonreciprocal line section (nonreciprocal section: NRS) having an electrical length $L_{NR}$ in the Y-axis direction and a reciprocal line section (Reciprocal Section: RS) along the propagation direction (which is the direction along the Y axis) of electromagnetic waves in a manner similar to that of Non-Patent Document 3. Referring to FIG. 13A, one pair of line sections NR and NRS becomes a T-type unit cell 60E of a period length p. Further, the lumped element capacitors each having a capacitance $2C_{se}$ are inserted in the series branch on both sides of the unit cells 60E connected in cascade.

Figure 14:
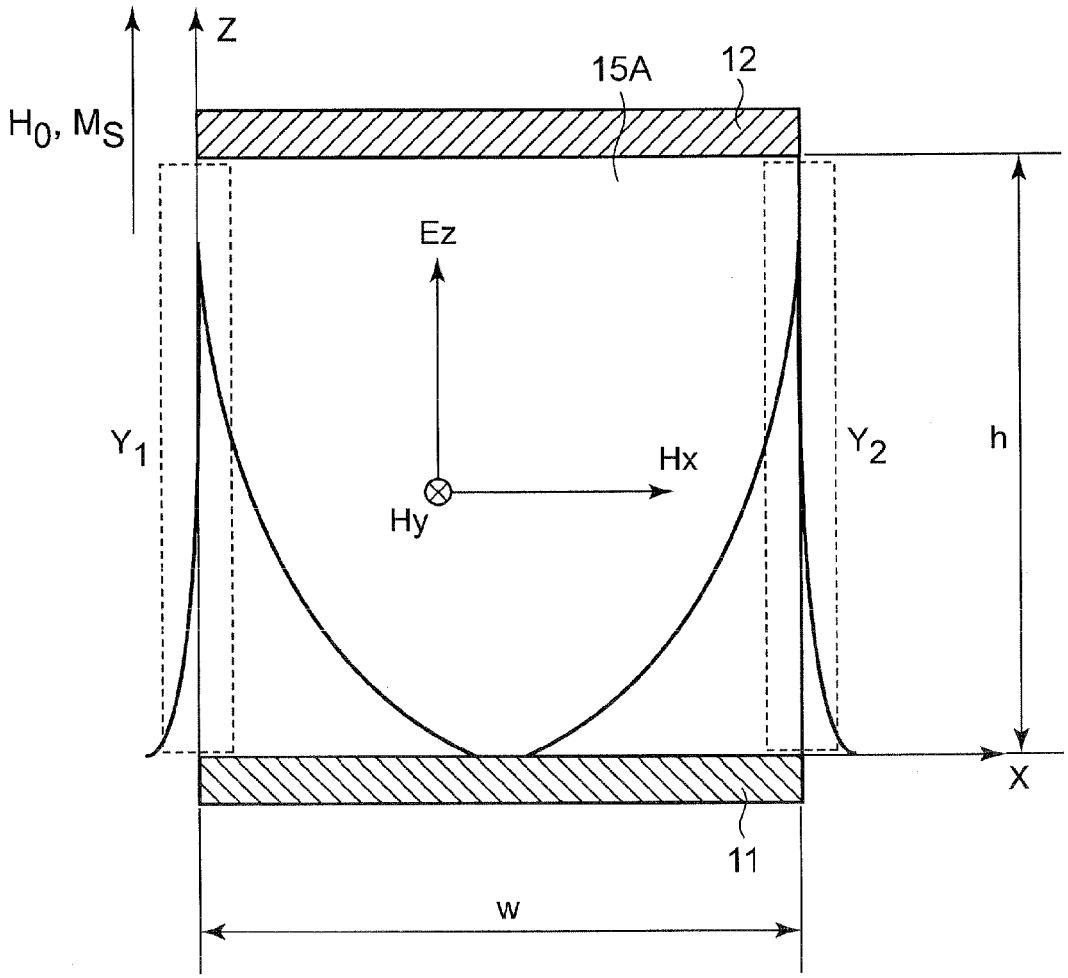
FIG. 14 is a longitudinal sectional view of a ferrite square bar 15A in a nonreciprocal line section NRS of FIG. 13A.

FIG. 14 is a longitudinal sectional view of the ferrite square bar 15A in the nonreciprocal line section NRS of FIG. 13A. Referring to FIG. 14, since the stub conductors 13A and 13B are provided between the ports P1 and P2 for the microstrip line 12E in the nonreciprocal line section NRS, the boundary conditions at the boundaries on the −X side and the +X side of the microstrip line 12E are expressed by using mutually different equivalent admittances $Y_1$ and $Y_2$. In this case, the admittances $Y_1$ and $Y_2$ are given respectively by the stub conductors 13A and 13B configured of short-circuit-terminated or open-terminated limited-length microstrip line. On the other hand, in the reciprocal line section RS, a stub conductor is provided neither in the −X direction nor the +X direction for the microstrip line 12E, in which the ferrite square bar 15A is embedded. Therefore, the boundary conditions at each of the boundaries on the −X side and the +X side of the microstrip line 12E become a magnetic wall (whose impedance is infinite).

If the magnetic wall type boundary conditions are applied to the reciprocal line section RS, this leads to the edge guide mode simple dispersion relation described in Non-Patent Document 2.

On the other hand, by the eigenmode analysis proposed in Non-Patent Document 3, the dispersion relation to the nonreciprocal line section NRS is given in a manner similar to that of the following equation:

$$j\cot(wk_x) = \frac{\dfrac{\gamma^2}{(\omega/c)} + \mu\left(\tilde{Y}_1\tilde{Y}_2\dfrac{\mu^2-\mu_a^2}{\mu} + \varepsilon_r\right)\left(\dfrac{\omega}{c}\right)}{\mu k_x\left(\tilde{Y}_1+\tilde{Y}_2\right)} + \frac{\gamma\mu_a\left(\tilde{Y}_1-\tilde{Y}_2\right)}{\mu k_x\left(\tilde{Y}_1+\tilde{Y}_2\right)}. \tag{11}$$

It is noted that ω denotes an operating angular frequency, w is a width of the ferrite square bar 15A, c denotes a velocity of light in vacuum, and $\epsilon_r$ denotes a relative dielectric constant of the ferrite square bar 15A. The physical amount μ and $\mu_a$ denote a diagonal component and a non-diagonal component of the Polder relative permeability tensor:

$$\hat{\mu}_r = \begin{bmatrix} \mu & j\mu_a & 0 \\ -j\mu_a & \mu & 0 \\ 0 & 0 & 1 \end{bmatrix}$$

of the ferrite square bar 15A magnetized in the Z-axis positive direction.

Moreover, $$\tilde{Y}_1 = Y_1\sqrt{\mu_0/\epsilon_0},\ \tilde{Y}_2 = Y_2\sqrt{\mu_0/\epsilon_0},$$

where $\mu_0$ is a permeability in vacuum, and $\epsilon_0$ is a dielectric constant in vacuum. Further, in the Equation (11), $k_x$ that means a wave number in the transverse direction is given by the following equation:

$$k_x^2 = \gamma^2 + (\mu^2 - \mu_a^2)\epsilon_r\omega^2/(\mu c^2).$$

Moreover, a complex propagation constant γ can be written as $\gamma = \alpha + j\beta$ by using a decay constant α and a phase constant β.

Regarding the macroscopic characteristics of the reciprocal line section RS and the nonreciprocal line section NRS, the characteristic impedance is estimated from the electromagnetic field distribution as a ratio of integral value of a pointing vector in a cross section to a surface current along the microstrip line 12E. A relation between an electric field component $E_Z$ of electromagnetic waves and magnetic field components $H_X$ and $H_Y$ can be obtained from the Maxwell equation. If there is no transmission loss, the characteristic impedance is reciprocal.

Next, an analysis of the eigenmode of propagation along the nonreciprocal transmission line apparatus 70E is performed. The features of the structure of the nonreciprocal transmission line apparatus 70E can be obtained by an ABCD matrix $F_{UC}$ with respect to the unit cell 60E. It is noted that the ABCD matrix $F_{UC}$ with respect to the unit cell 60E is expressed as $F_{UC} = F_{2C}F_{RS}F_{NRS}F_{RS}F_{2C}$ as a product of a matrix $F_{RS}$ to the reciprocal line section RS, a matrix $F_{NRS}$ to the nonreciprocal line section NRS, and a matrix $F_{2C}$ to the capacitor of the capacitance $2C_{se}$. In this case, if periodic boundary conditions are applied to the traveling direction for the matrix $F_{UC}$, the dispersion relation is obtained by the following equation:

$$det[F_{UC} - \hat{I}\exp(\gamma_{MMp})] = 0,$$

where $\gamma_{MM}$ represents a complex propagation constant of the mode of propagation along the periodic structure.

This equation can be formulated by using a magnitude of the nonreciprocal phase shift amount $\beta_{NR}$ in the nonreciprocal line section NRS. In concrete, the nonreciprocal phase shift amount in the nonreciprocal line section NRS can be approximately expressed by a perturbation method on the assumption that $\mu_a$ has a small value. By applying the perturbation method to the dispersion relation of the nonreciprocal CRLH metamaterial, the magnitude of the nonreciprocal phase shift amount $\beta_{NR}$ is given by the following equation:

$$\beta_{NR} = \frac{(\omega_M/c)\left(\tilde{Y}_2-\tilde{Y}_1\right)}{w\left(\dfrac{\omega}{c}\right)\dfrac{\left(\tilde{Y}_2+\tilde{Y}_1\right)}{2} - 2j}\,\frac{L_{NR}}{p}. \tag{12}$$

It is noted that $\omega_M$ is $(|g|\mu_0 M_S)$, and g denotes a gyromagnetic ratio. As apparent from the Equation (12), the nonreciprocity of the structure of the nonreciprocal transmission line apparatus 70E is caused by (a) the asymmetry of the structure expressed by the following:

$$(\tilde{Y}_2-\tilde{Y}_1)$$

and (b) $\omega_M=|g|\mu_0 M_S$ that means the magnitude of the magnetization of the ferrite square bar 15A. On the other hand, in the Equation (12), the term of:

$$(\tilde{Y}_2+\tilde{Y}_1)$$

represents the sum total of the admittances $Y_1$ and $Y_2$ of the two stub conductors 13A and 13B (See Non-Patent Document 4). The imaginary part of the total admittance of the inductive stub having a negative dielectric constant assumes a negative value. In the lossless case, the nonreciprocity appears only in the phase constant, the nonreciprocity appears only in the phase constant as pointed by, for example, Non-Patent Document 3.

Figure 15:
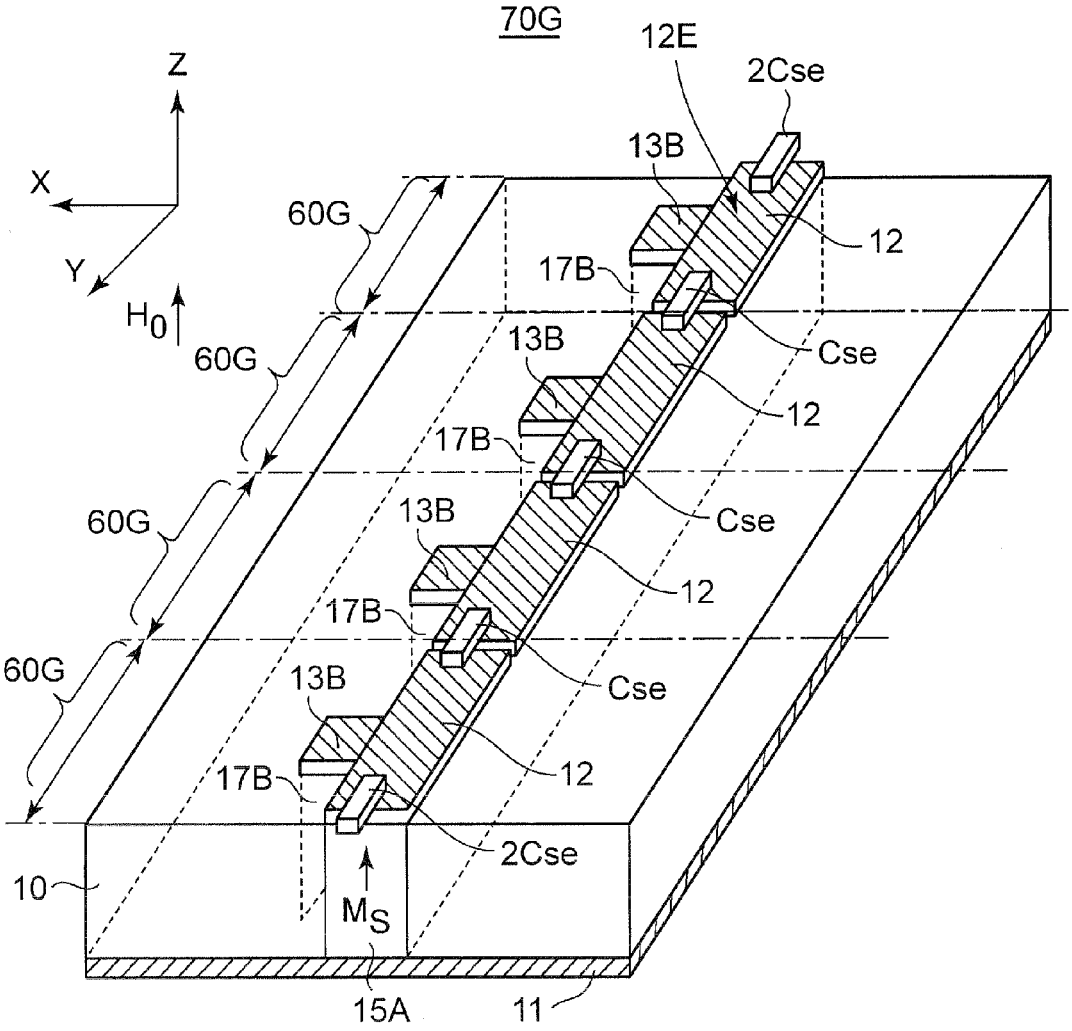
FIG. 15 is a perspective view showing a configuration of a nonreciprocal transmission line apparatus 70G according to a comparative example.

FIG. 15 is a perspective view showing a configuration of a nonreciprocal transmission line apparatus 700 according to a comparative example. The nonreciprocal transmission line apparatus 700 of FIG. 15 is different from the nonreciprocal transmission line apparatus 70E of the present embodiment such that unit cells 60G are provided in place of the unit cells 60E. In this case, the unit cells 600 is different from the unit cells 60E such that the stub conductor 13A is not provided, and the stub conductor 13B is provided only on the +X side of the strip conductor 12. Consequently, the stub conductors 13B are periodically inserted only on the +X side of the microstrip line 12E, and such propagation characteristics that the dielectric constant becomes negative are obtained. In Non-Patent Document 3, the characteristics of the nonreciprocal transmission line apparatus 700 are analyzed in a simple case where such propagation characteristics that the dielectric constant becomes negative are given.

Figure 16:
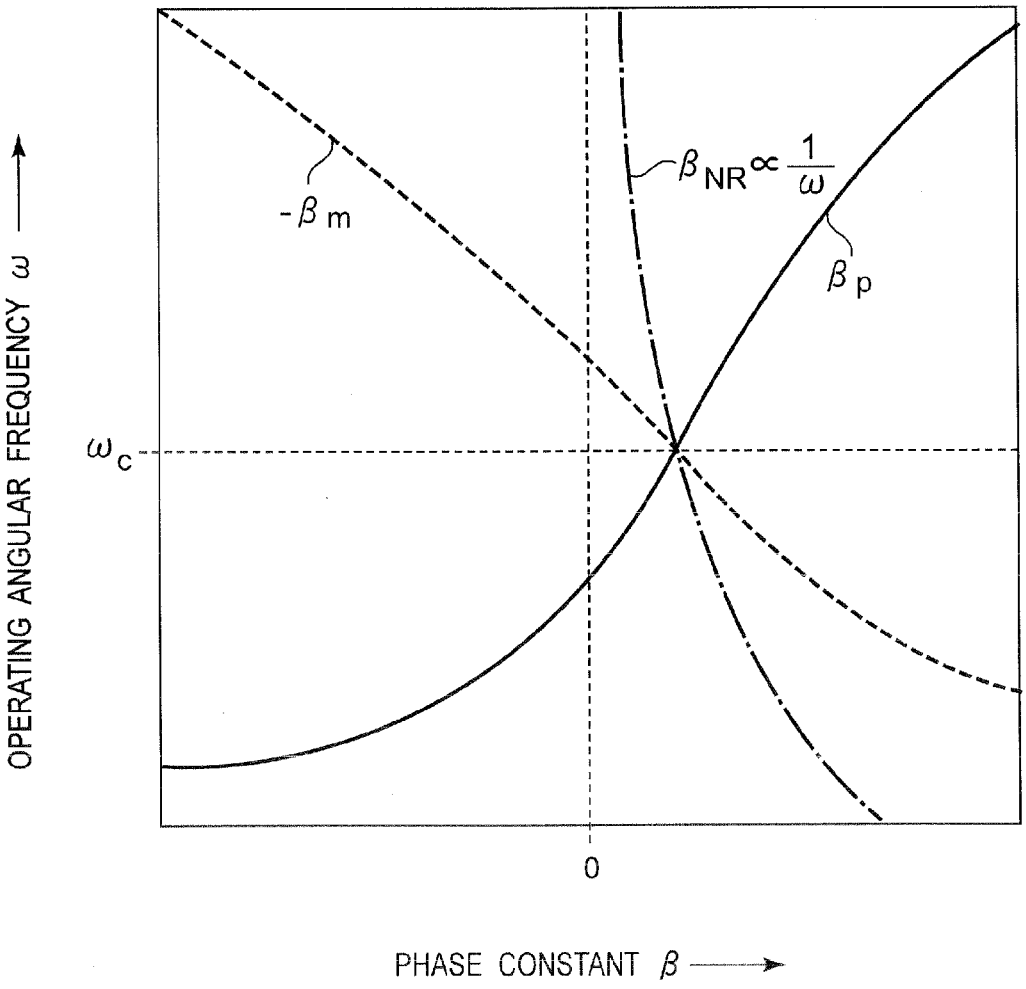
FIG. 16 is a graph showing dispersion curves of the nonreciprocal transmission line apparatus 70G of FIG. 15, and showing simulation calculated values of frequency characteristics of the nonreciprocal phase shift amount $\beta_{NR}$.
Figure 17:
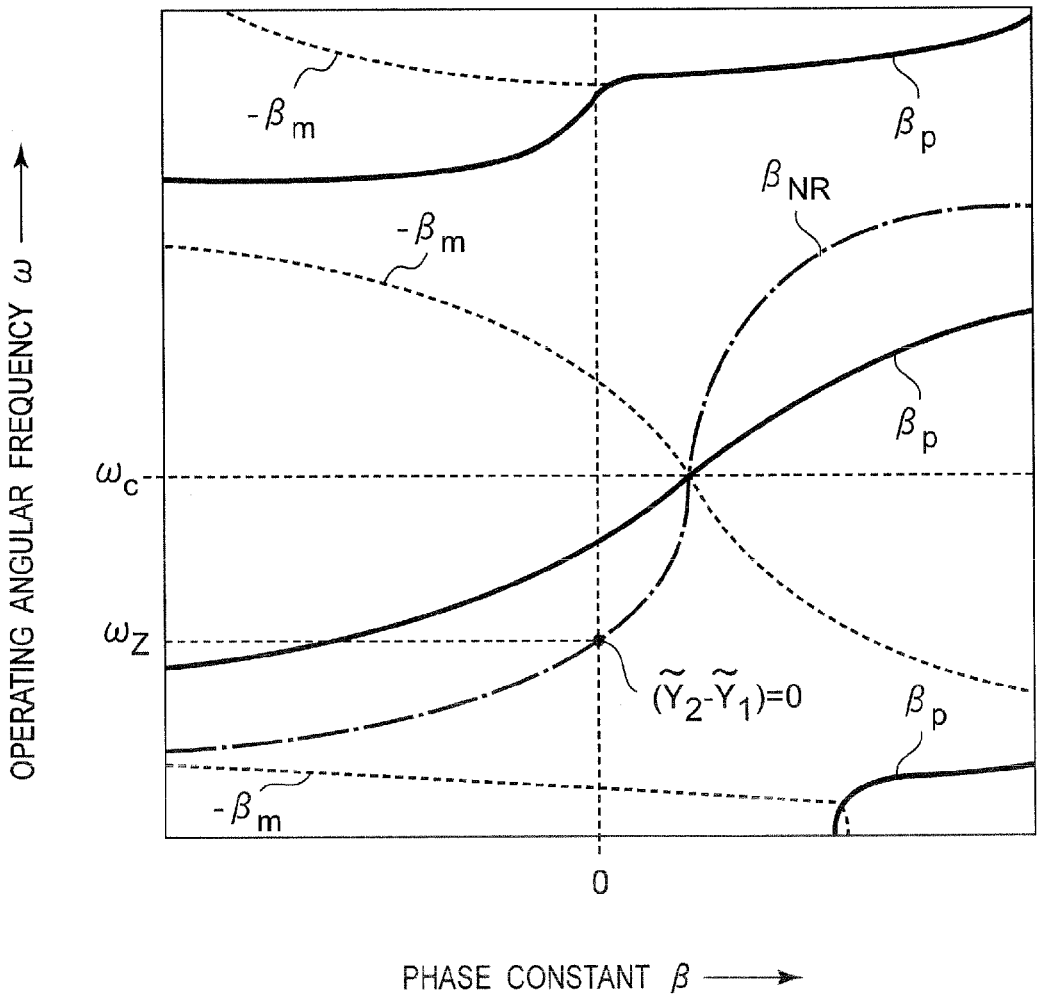
FIG. 17 is a graph showing dispersion curves of the nonreciprocal transmission line apparatus 70E of FIG. 13A, and showing simulation calculated values of the frequency characteristics of the nonreciprocal phase shift amount $\beta_{NR}$.

FIG. 16 is a graph showing dispersion curves of the nonreciprocal transmission line apparatus 70G of FIG. 15, and showing simulation calculated values of the frequency characteristics of the nonreciprocal phase shift amount $\beta_{NR}$. Moreover, FIG. 17 is a graph showing dispersion curves of the nonreciprocal transmission line apparatus 70E of FIG. 13A, and showing simulation calculated values of the frequency characteristics of the nonreciprocal phase shift amount $\beta_{NR}$. The aforementioned Equation (12) represents that the nonreciprocal phase shift amount $\beta_{NR}$ is approximately inversely proportional to the operating angular frequency $\omega$ in the nonreciprocal transmission line apparatus 70G of FIG. 15, in which the stub conductor is inserted only on one side of the microstrip line 12E (See FIG. 16). On the other hand, if the stub conductors 13A and 13B are inserted on both sides of the microstrip line 12E in a manner similar to that of the nonreciprocal transmission line apparatus 70E of the present embodiment of FIG. 13A, the nonreciprocal phase shift amount $\beta_{NR}$ becomes not inversely proportional to the operating angular frequency $\omega$ (See FIG. 17).

Moreover, as shown in FIG. 16, in the nonreciprocal transmission line apparatus 70G of FIG. 15, in which the stub conductor 13B is inserted only on one side of the microstrip line 12E, a first derivative $d\beta_{NR}(\omega)/d\omega$ relevant to the operating angular frequency $\omega$ of the nonreciprocal phase shift amount $\beta_{NR}$ becomes $d\beta_{NR}(\omega)/d\omega<0$ (See Non-Patent Documents 1, 3 and 4).

On the other hand, as shown in FIG. 17, in the nonreciprocal transmission line apparatus 70E of FIG. 13A, in which the stub conductors 13A and 13B are inserted on both sides of the microstrip line 12E, the sign of the first derivative $d\beta_{NR}(\omega)/d\omega$ relevant to the operating angular frequency $\omega$ of the nonreciprocal phase shift amount $\beta_{NR}$ is inverted when the nonreciprocal phase shift amount $\beta_{NR}$ becomes zero at a predetermined operating angular frequency $\omega_Z$ longer than the center angular frequency $\omega_C$, and this leads to $d\beta_{NR}(\omega)/d\omega>0$. Consequently, it can be understood that the nonreciprocal transmission line apparatus 70E can be designed so that any beam squint does not substantially occur since the nonreciprocal phase shift amount $\beta_{NR}$ is substantially proportional to the operating angular frequency $\omega$ in the vicinity of the center angular frequency $\omega_C$.

In the leaky wave antenna of resonance type using the nonreciprocal transmission line apparatus 70E, the present embodiment utilizes the fact that the admittances $Y_1$ and $Y_2$ change in accordance with the frequency in order to prevent the occurrence of the beam squint that the beam angle $\theta$ changes in accordance with the operating frequency. In general, the admittances $Y_1(\omega)$ and $Y_2(\omega)$ can be expressed by using the relational expression of the input impedance in the finite length microstrip line, in which the load impedance is connected to a transmission line terminal. In general, the input admittance contains a cotangent function or a tangent function when the transmission line terminal end is short-circuited or opened, and therefore, the input admittance has a singular point or a significant point at a predetermined frequency, and exhibits discontinuity.

Referring to the Equation (12), the nonreciprocal phase shift amount $\beta_{NR}$ becomes zero when $$\tilde{Y}_2-\tilde{Y}_1=0$$

i.e., when $Y_1=Y_2$, and a comparatively large nonreciprocal phase shift characteristic can also be obtained at a further operating angular frequency $\omega$. From the characteristics of the trigonometric function owned by the admittances $Y_1$ and $Y_2$ of the inserted stub conductors 13A and 13B, such conditions of the admittances $Y_1$ and $Y_2$ can be found that the aforementioned beam squint becomes zero between two singular points (frequencies) at which $$\tilde{Y}_1(\omega) \text{ or } \tilde{Y}_2$$

becomes discontinuous, i.e., the conditions of the electrical lengths La and Lb.

Figure 18:
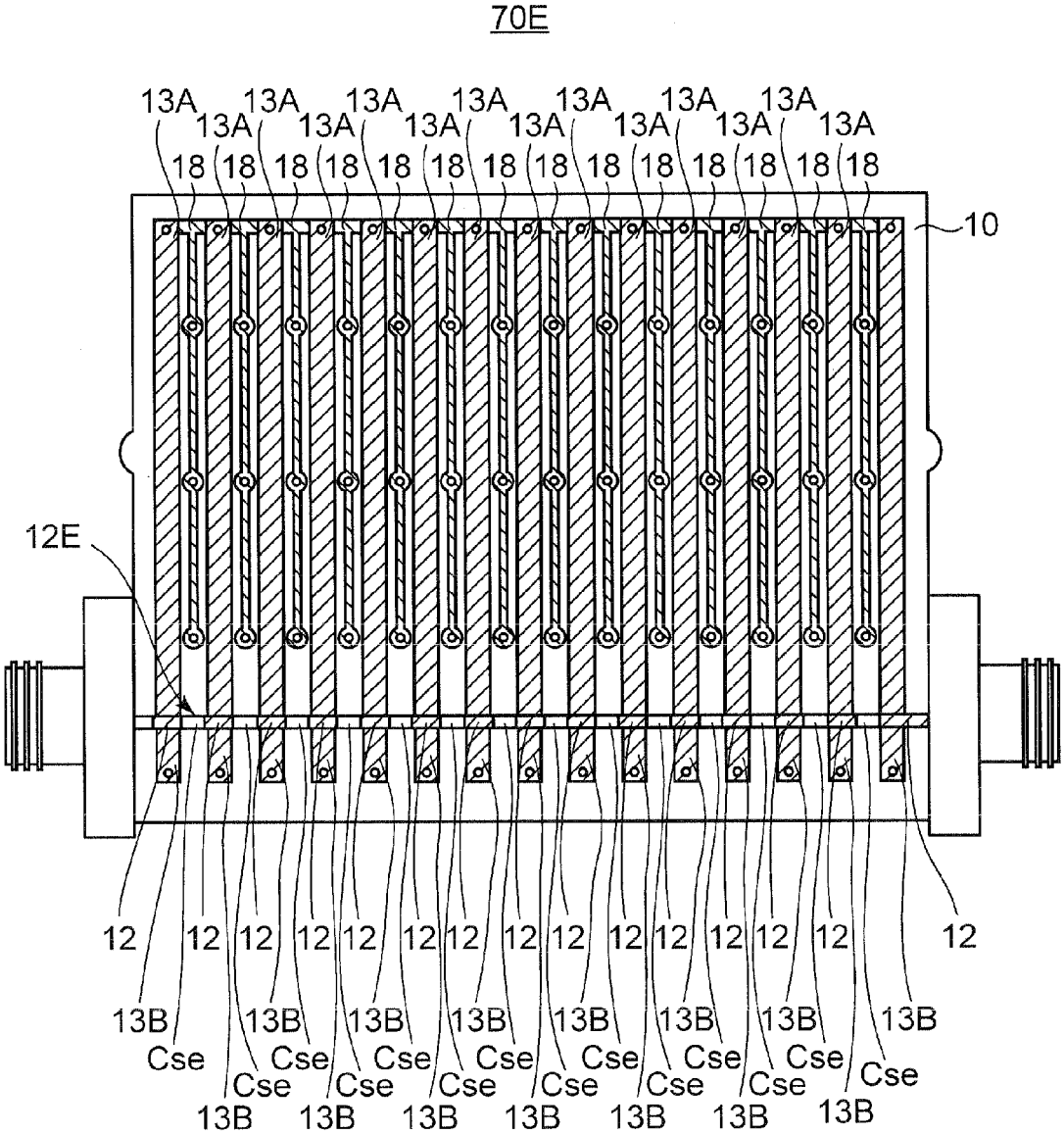
FIG. 18 is a plan view showing a concrete configuration of the nonreciprocal transmission line apparatus 70E of FIG. 13A.
Figure 19:
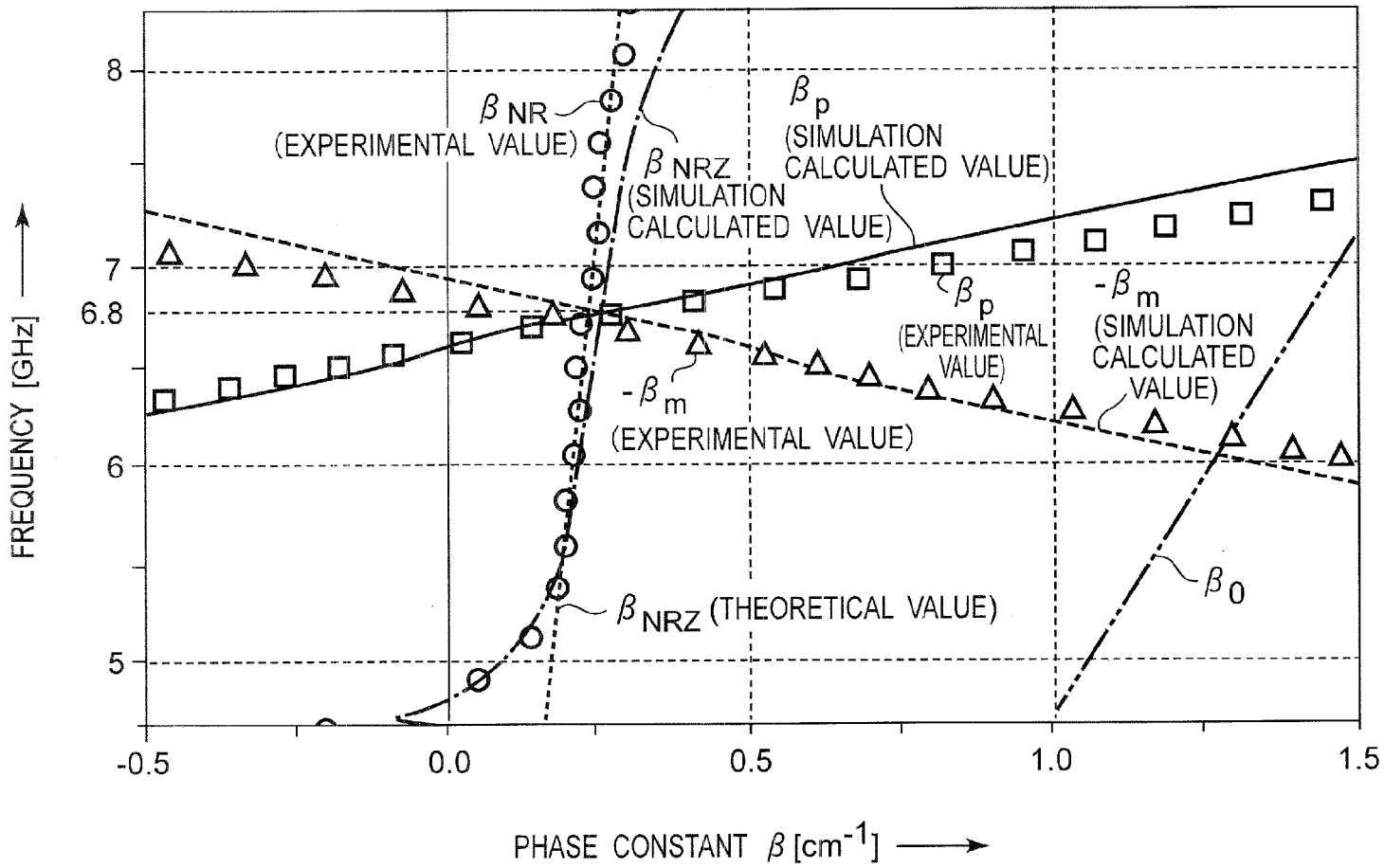
FIG. 19 is a graph showing dispersion curves of the nonreciprocal transmission line apparatus 70E of FIG. 13A, showing simulation calculated values of the frequency characteristics of the nonreciprocal phase shift amount $\beta_{NR}$, and showing experimental values when the nonreciprocal transmission line apparatus 70E of FIG. 13A is formed in a manner similar to that of FIG. 18.

FIG. 19 is a graph showing dispersion curves of the nonreciprocal transmission line apparatus 70E of FIG. 13A, showing simulation calculated values of the frequency characteristics of the nonreciprocal phase shift amount $\beta_{NR}$, and showing experimental values when the nonreciprocal transmission line apparatus 70E of FIG. 13A is formed in a manner similar to that of FIG. 18 (described later). In FIG. 19 are shown the simulation calculated values of the phase constant $\beta_p$ when the transmission power is in the forward direction (positive direction), the phase constant $-\beta_m$ when it is in the backward direction (negative direction), and the nonreciprocal phase shift amount $\beta_{NR}$ calculated on the basis of the phase constants $\beta_p$ and $-\beta_m$. The finite element method was used for the simulations. Further, the theoretical value of the nonreciprocal phase shift amount $\beta_{NRZ}$ when any beam squint does not occur at all and the phase constant $\beta_0$ in vacuum are additionally shown. The center angular frequency $\omega_C$ of the antenna using the nonreciprocal transmission line apparatus 70E is defined by the operating angular frequency at the intersection of two dispersion curves in the left-handed mode and the right-handed mode, and the center angular frequency $\omega_C$ can be confirmed to be 6.8 GHz in FIG. 19. Moreover, it can be understood that the nonreciprocal phase shift amount $\beta_{NR}$ comes close to the nonreciprocal phase shift amount $\beta_{NRZ}$ in the ideal case where any beam squint does not occur at all in the vicinity of the center angular frequency $\omega_C$, and any beam squint does not substantially occur.

FIG. 18 is a plan view showing a concrete configuration of the nonreciprocal transmission line apparatus 70E of FIG. 13A. As shown in FIG. 19, an experimental model of the nonreciprocal transmission line apparatus 70E was manufactured for trial purposes. In the nonreciprocal transmission line apparatus 70E of FIG. 19, a ferrite square bar 15A made of yttrium iron garnet (YIG) having a sectional size of 0.8 mm×0.8 mm is embedded under the microstrip line 12E. Moreover, the stub conductors 13A and 13B were formed on the dielectric substrate 10 of Rexolite (registered trademark) 2200. Further, the electrical length La of the stub conductor 13A was set to 25 mm, and the electrical length Lb of the stub conductor 13B was set to 2.5 mm. The width of each of the stub conductors 13A and 13B was set to 1 mm, and the period length "p" of the unit cells 60E was set to 3 mm. The capacitance of the capacitors Cse was set to 0.5 pF so that dispersion characteristics having no band-gap between the right-handed mode and the left-handed mode result. Moreover, as shown in FIG. 18, a grounding conductor 18 having a width thinner than the width of the stub conductor 13A was formed between adjacent stubs 13A in order to suppress the capacitive coupling between the adjacent stub conductors 13A.

The phase constants $\beta_p$ and $-\beta_m$ and the nonreciprocal phase shift amount $\beta_{NR}$ at the time of manufacturing the nonreciprocal transmission line apparatus 70E of FIG. 13A in a manner similar to that of FIG. 18 for trial purposes are shown in FIG. 19. As shown in FIG. 19, the experimental values coincide well with the respective simulation calculated values. In particular, in the band from 5.3 GHz to 7.7 GHz, the dispersion characteristics of the nonreciprocal phase shift amount $\beta_{NR}$ coincide well with the nonreciprocal phase shift amount $\beta_{NRZ}$ in the ideal case where any beam squint does not occur in the pseudo traveling wave resonator antenna. That is, according to the nonreciprocal transmission line apparatus 70E of the present embodiment, such an antenna apparatus of resonance type that any beam squint does not substantially occur in the vicinity of the center angular frequency $\omega_C$ of the operation band can be achieved.

As described above, it has been described that the occurrence of the beam squint can be substantially prevented in the antenna apparatus using the nonreciprocal transmission line apparatus 70E by analyzing the magnitudes of the phase constants $\beta_p$ and $-\beta_m$ in the nonreciprocal transmission line apparatus 70E. Moreover, when the nonreciprocal transmission line apparatus 70E was manufactured for trial purposes and the transmission characteristics were measured, it was confirmed that the experimental values coincided well with the simulation calculated values. Therefore, if the nonreciprocal transmission line apparatus 70E is applied to the leaky wave antenna of resonance type, a beam scanning antenna apparatus can be achieved, in which the beam squint does not substantially occur.

MODIFIED EMBODIMENTS

Figure 20A:
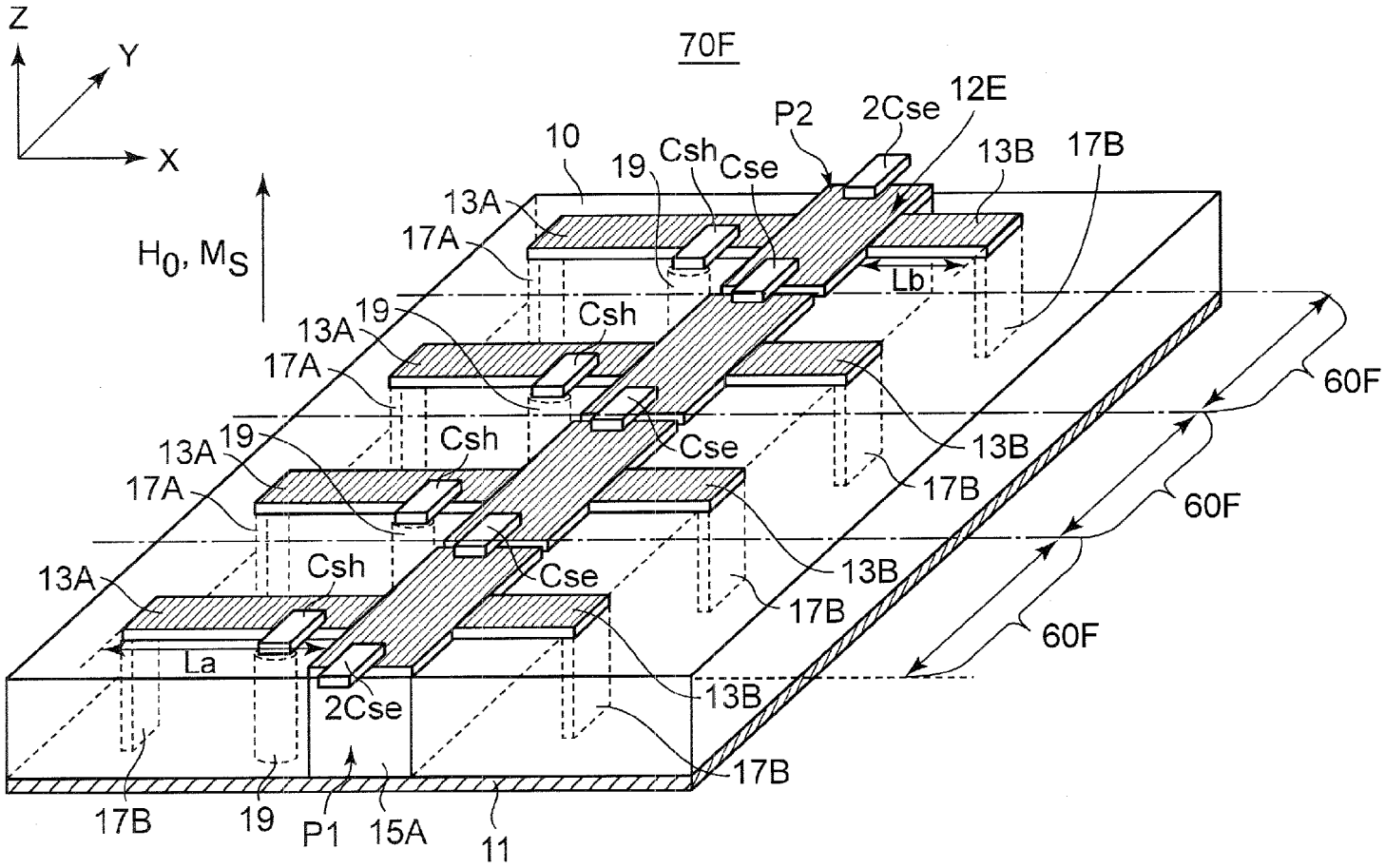
FIG. 20A is a perspective view showing a configuration of a nonreciprocal transmission line apparatus 70F according to a modified embodiment of the present invention.

FIG. 20A is a perspective view showing a configuration of a nonreciprocal transmission line apparatus 70F according to a modified embodiment of the present invention. Referring to FIG. 20A, the nonreciprocal transmission line apparatus 70F is different from the nonreciprocal transmission line apparatus 70E of the embodiment such that unit cells 60F are provided in place of the unit cells 60E. Moreover, the unit cells 60F is different from the unit cells 60E only such that capacitors Csh of chip capacitors are further provided. Hereinafter, only the different points from those of the embodiment are described. Referring to FIG. 20A, one electrode of each capacitor Csh is connected to a predetermined connection point of the longer stub conductor 13A of the stub conductors 13A and 13B, while the other electrode of the capacitor Csh is connected to the grounding conductor 11 via a via conductor 19.

As described in the embodiments, the admittances $Y_1$ and $Y_2$ of the stub conductors 13A and 13B give frequency dependence to the boundary conditions on the side surface on the −X side and the side surface on the +X side of the microstrip line 12E. In this case, it is possible to make $\beta_{NR}=0$ at a predetermined operating angular frequency $\omega_Z$ lower than the center angular frequency $\omega_C$ by using the stub conductors 13A and 13B having admittances $Y_1$ and $Y_2$, respectively, which are different from each other, and are inserted on both sides of the microstrip line 12E. On the other hand, it is possible to secure large nonreciprocity at a frequency higher than the center angular frequency $\omega_C$ and to further make the nonreciprocal phase shift amount $\beta_{NR}(\omega)$ an increasing function (See FIG. 17).

In FIG. 20A, the equivalent admittance $Y_1$ of the grounded longer stub conductor 13A is expressed by the following equation, using the characteristic impedance $Z_{st}$ of the microstrip line including the stub conductor 13A, the effective dielectric constant $\epsilon_{st}$, and the electrical length La of the stub conductor 13A:

$$Y_1=-z_{st}^{-1}\cot(La\sqrt{\epsilon_{st}}\omega/c).$$

By combining the grounded stub conductor 13A with the grounded stub conductor 13B, the condition of $\beta_{NR}=0$ can be approximately satisfied at the operating angular frequency $\omega_Z$ lower than the center angular frequency $\omega_C$. In this case, the fact that the aforementioned condition is satisfied at the angular frequency that is not so much separated from the angular frequency $\omega=\pi c/La\sqrt{\epsilon_{st}}$ can be analogized by the function form of the admittance $Y_1$ of the stub conductor 13A.

In this case, the fact that the nonreciprocal phase shift amount $\beta_{NR}(\omega)$ is the increasing function of the operating angular frequency $\omega$ does not mean that the beam squint can be easily made to disappear but sometimes deteriorates the maximum radiation beam angle as described in the embodiment. In the present modified embodiment, the admittance $Y_1$ of the longer stub conductor 13A is adjusted by providing an additional capacitor Csh. With this arrangement, the controllability of the nonreciprocal phase shift amount $\beta_{NR}(\omega)$ can be improved as compared with the embodiment. With this arrangement, the nonreciprocal transmission line apparatus 70F can be designed so that $\beta_{NR}(\omega)\propto\omega$ substantially results in the vicinity of the center angular frequency $\omega_C$ when the value of the nonreciprocal phase shift amount $\beta_{NR}(\omega)$ is larger. Therefore, the occurrence of the beam squint can easily be suppressed as compared with the embodiment.

Figure 20B:
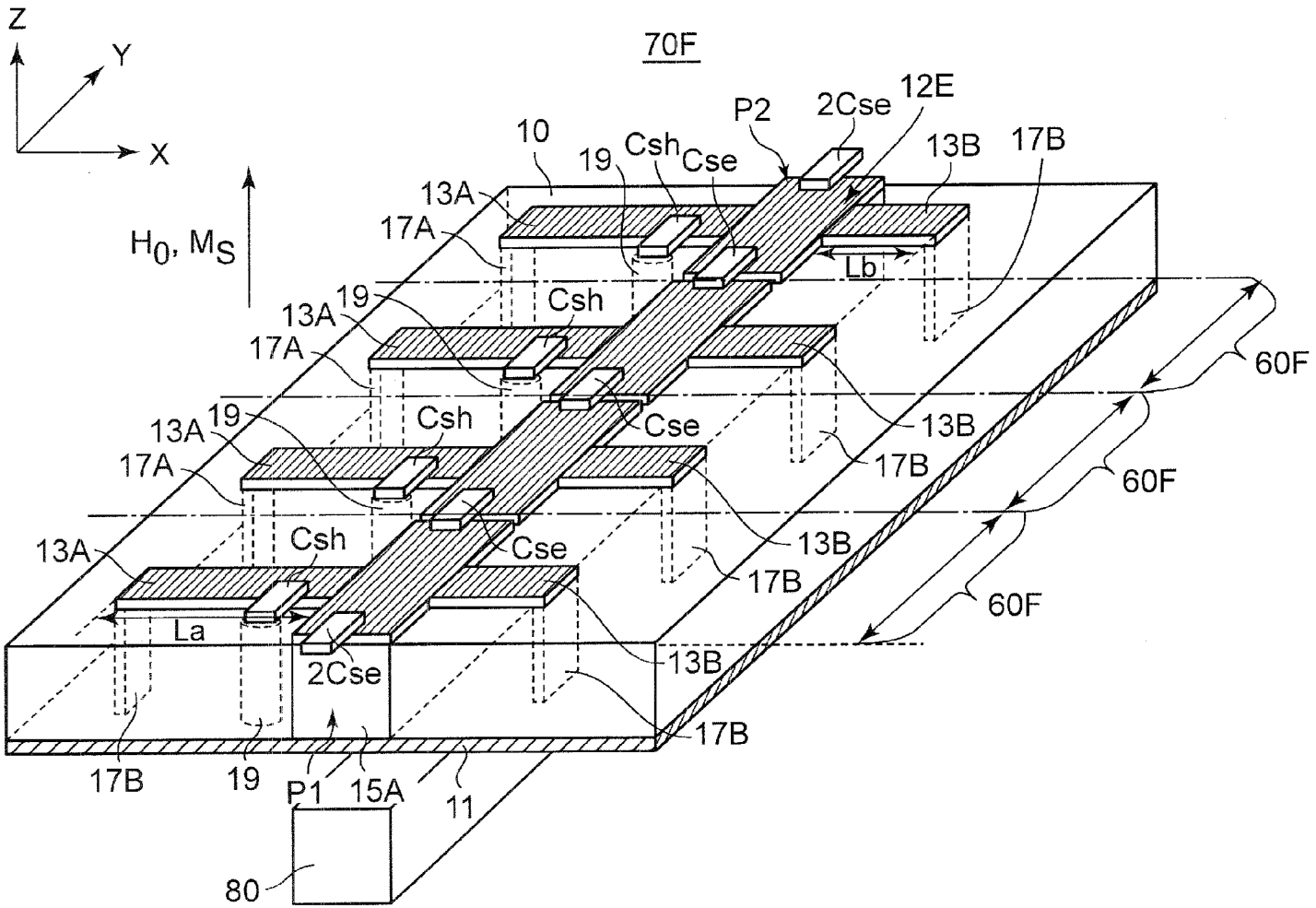
FIG. 20B is a perspective view showing a configuration of a modified embodiment of the nonreciprocal transmission line apparatus 70F of FIG. 20A.

It is acceptable to use a ferrite square bar having no spontaneous magnetization in place of the ferrite square bar 15A having spontaneous magnetization and apply a magnetic field by the external magnetic field generator 80 of FIG. 20B.

Figure 21:
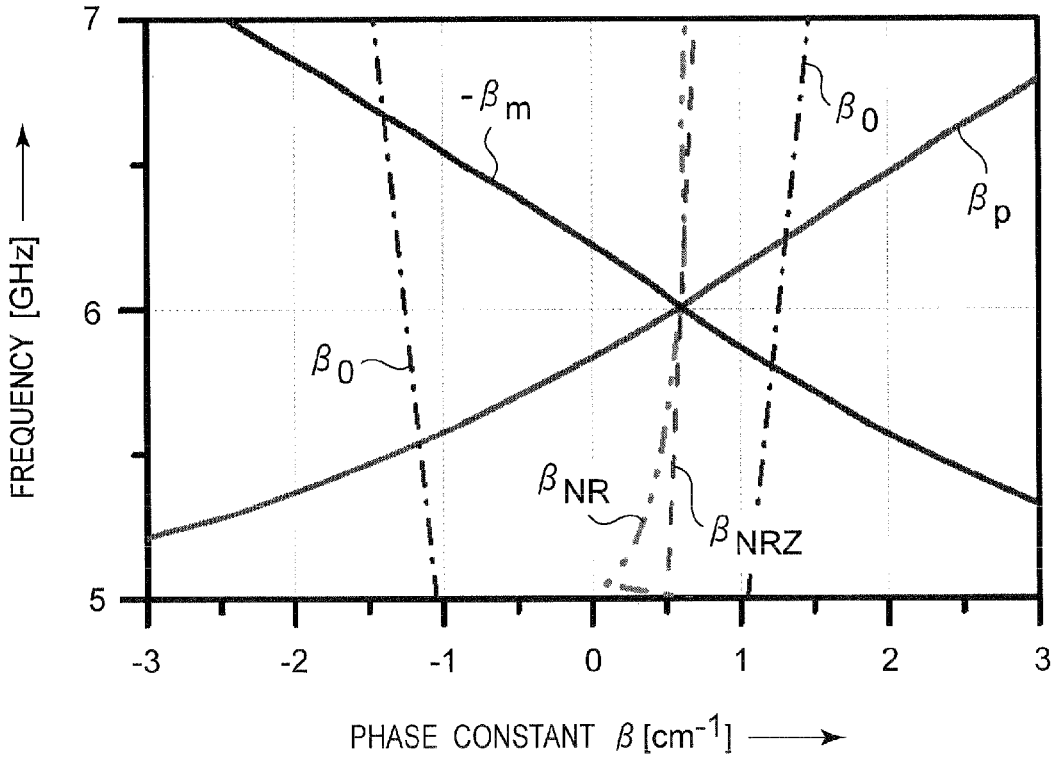
FIG. 21 is a graph showing dispersion curves of the nonreciprocal transmission line apparatus 70F of FIG. 20A, and showing simulation calculated values of the frequency characteristics of the nonreciprocal phase shift amount $\beta_{NR}$.

FIG. 21 is a graph showing dispersion curves of the nonreciprocal transmission line apparatus 70F of FIG. 20A, and showing simulation calculated values of the frequency characteristics of the nonreciprocal phase shift amount $\beta_{NR}$, and FIG. 22 is an enlarged view of FIG. 21. The finite element method was used for the simulations. A ferrite square bar 15A made of yttrium iron garnet (YIG) having a sectional size of 0.8 mm×0.8 mm was embedded under the microstrip line 12E. Moreover, the electrical length La of the stub conductor 13A was set to 25.5 mm so that the nonreciprocal phase shift amount $\beta_{NR}$ becomes zero at 5 GHz, which is lower than the frequency corresponding to the center angular frequency $\omega_C$, the electrical length Lb of the stub conductor 13B was set to 1.3 mm, and the width of the stub conductors 13A and 13B was set to 1 mm. Further, the capacitance of the capacitor Csh was set to 0.4 pF so that the beam squint does not substantially occur, and the capacitance of the capacitor Cse was set to 0.65 pF so to obtain a dispersion characteristic having no band-gap between the right-handed mode and the left-handed mode. Further, the relative dielectric constant of the dielectric substrate 10 was set to 2.6.

As described above, the electrical lengths La and Lb of the stub conductors 13A and 13B are set to 25.5 mm and 1.3 mm, respectively, and the nonreciprocal transmission line apparatus 70F has a structure of a strong asymmetry with respect to the microstrip line 12E. As shown in FIGS. 21 and 22, the operating frequency $\omega_C/(2\pi)$ at the intersection of two dispersion curves became 6.0 GHz. Moreover, the nonreciprocal phase shift amount $\beta_{NR}$ is proportional to the frequency in the vicinity of the operating frequency $\omega_C/(2\pi)$ and comes close to the nonreciprocal phase shift amount $\beta_{NRZ}$ when the beam squint does not occur at all. Further, if the magnitude of the obtained nonreciprocal phase shift amount $\beta_{NRZ}$ is converted into the radiation beam angle of the antenna apparatus designed on the basis of this structure, it has been confirmed that beam scanning could be performed up to an angle of 28 degrees at maximum.

As described in detail above, the nonreciprocal transmission line apparatuses 70E and 70F are configured by connecting in cascade the unit cells 60E or 60F between the ports P1 and P2, where the propagation constant in the forward direction and the propagation constant in the backward direction are different from each other. In this case, each of the unit cells 60E and 60F has a microwave transmission line section, a capacitor Cse that is the series branch circuit equivalently containing a capacitance element, and first and second parallel branch circuits that are each provided branched from the microwave transmission line section and equivalently containing an inductive element. Moreover, the transmission line section has spontaneous magnetization so as to have gyro anisotropy by being magnetized in a direction different from the propagation direction of microwaves or is magnetized by external magnetization. Further, the first parallel branch circuit is the stub conductor 13A having an electrical length La, and the second parallel branch circuit is the stub conductor 13B having an electrical length Lb shorter than the electrical length La.

Further, when the phase constant in the first mode of propagation in the forward direction is assumed to be $\beta_p$, and the phase constant in the second mode of propagation in the backward direction is assumed to be $\beta_m$, the electrical lengths La and Lb are characterized by being set so that the function of the nonreciprocal phase shift amount $\beta_{NR}=(\beta_p-\beta_m)/2$ with respect to the operating angular frequency comes close to the function $\beta_{NRZ}$ of the nonreciprocal phase shift amount $\beta_{NR}$ with respect to the operating angular frequency, when the beam squint of such a phenomenon that the radiation direction of electromagnetic waves radiated from the nonreciprocal transmission line apparatus changes in accordance with the frequency does not occur in the vicinity of the intersection of the first dispersion curve that exhibits the relation between the phase constant $\beta_p$ and the operating angular frequency and the second dispersion curve that exhibits the relation between the phase constant $\beta_m$ and the operating angular frequency.

More concretely, in the antenna apparatus having the nonreciprocal transmission line apparatus 70E or 70F, the nonreciprocal phase shift amount $\beta_{NR}$ is required to be proportional to the operating angular frequency $\omega$ in the vicinity of the center angular frequency $\omega_C$ in order to substantially prevent occurrence of the beam squint in the vicinity of the center angular frequency $\omega_C$ that is the operating angular frequency at the intersection of the aforementioned two dispersion curves. That is, the following equation is required to substantially hold in the vicinity of the center angular frequency $\omega_C$:

$$\frac{\beta_{NR}}{\beta_0} = \text{constant}.$$

Moreover, in order to make this equation hold, the electrical length La of the stub conductor 13A and the electrical length Lb of the stub conductor 13B are set so that the admittance $Y_1$ of the stub conductor 13A and the admittance $Y_2$ of the stub conductor 13B satisfy the following first and second conditions.

The first condition: The nonreciprocal phase shift amount $\beta_{NR}$ assumes the value of zero at the predetermined operating angular frequency $\omega_Z$, that is in the vicinity of the center angular frequency $\omega_C$ of the antenna apparatus having the nonreciprocal transmission line apparatus 70F and is lower than the center angular frequency $\omega_C$. That is, the admittances $Y_1$ and $Y_2$ of the stub conductors 13A and 13B inserted on both sides of the microstrip line 12E satisfy $Y_1=Y_2$ at the operating angular frequency $\omega_Z$ (See Equation (12)).

The second condition: Both of the admittances $Y_1$ and $Y_2$ must be inductive (inductance) at the aforementioned operating angular frequency $\omega_Z$. That is, since the stub conductors 13A and 13B must be inductive stubs having a negative dielectric constant at the operating angular frequency $\omega_Z$, $\mathrm{Im}(Y_1)=\mathrm{Im}(Y_2)<0$.

In the nonreciprocal transmission line apparatuses 70E and 70F, although one end of the stub conductor 13A is grounded, it may be opened. The inventor and others of the present application discovered that the electrical lengths La and Lb (La>Lb) should be set to satisfy the following additional third and fourth conditions depending on whether one end of the stub conductor 13A is grounded (short-circuit stub) or opened (open stub). It is noted that $\lambda$ is a guide wavelength in each of the following conditions.

The first case (in the case where the stub conductor 13A is a short-circuit stub):

The third condition: The stub conductor 13A is a short-circuit stub satisfying $La>\lambda/2$.

The fourth condition: The stub conductor 13B is a short-circuit stub that satisfying $Lb<\lambda/4$.

The second case (in the case where the stub conductor 13A is an open stub):

The third condition: The stub conductor 13A is an open stub satisfying $La>\lambda/4$.

The fourth condition: The stub conductor 13B is a short-circuit stub satisfying $Lb<\lambda/4$.

As described above, the nonreciprocal phase shift amount $\beta_{NR}$ can be increased by additionally connecting a lumped element capacitance such as a chip capacitor to the predetermined connection point of the stub conductor 13A in the first and second cases. Therefore, the occurrence of the beam squint can be substantially suppressed even if the radiation beam angle θ becomes relatively large.

Figure 23:
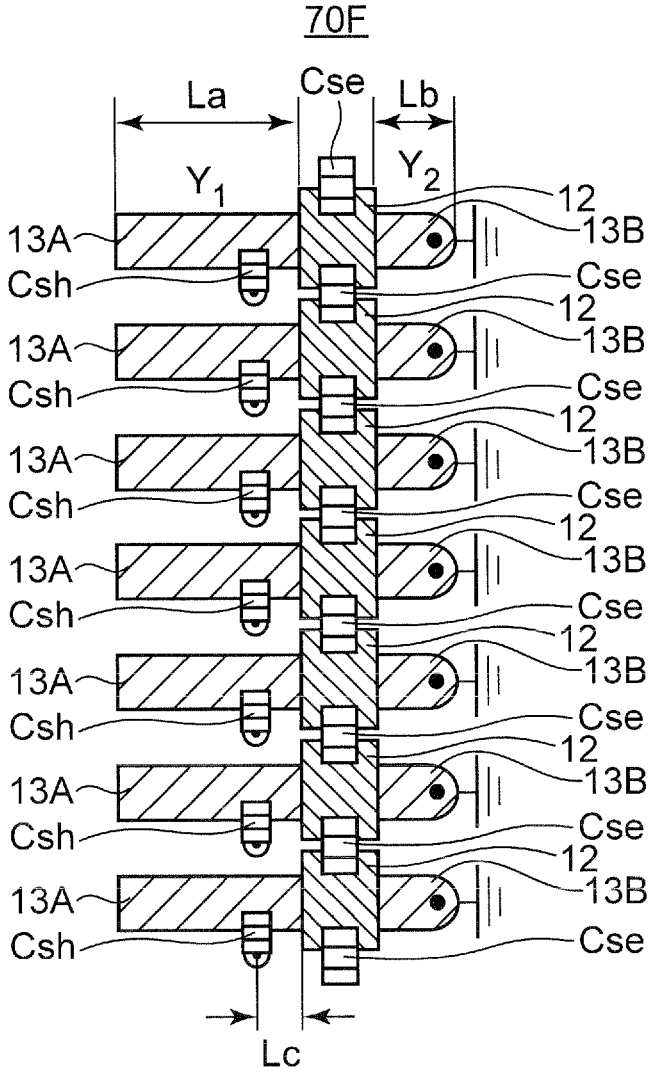
FIG. 23 is a plan view schematically showing a configuration of the nonreciprocal transmission line apparatus 70F when the stub conductors 13A of FIG. 20A are open stubs.

Next, the admittances $Y_1$ and $Y_2$ in the aforementioned second case are considered. FIG. 23 is a plan view schematically showing a configuration of a nonreciprocal transmission line apparatus 70F when the stub conductor 13A of FIG. 20A is an open stub. Moreover, FIG. 24 is a graph showing an operating angular frequency dependence of the admittances $Y_1$ and $Y_2$ in the nonreciprocal transmission line apparatus 70F of FIG. 23, and showing frequency dependence of the nonreciprocal phase shift amount $\beta_{NR}$.

Referring to FIG. 23, each of the stub conductors 13A and 13B operates as an inductive stub conductor. Moreover, as described above, the electrical length La is set to satisfy La>λ/4, and the electrical length Lb is set to satisfy Lb<λ/4. As shown in FIG. 24, when the stub conductor 13A is an open stub, the admittance $Y_1$ becomes a tangent function (tan) relevant to the operating angular frequency ω. Moreover, when the stub conductor 13B is a short-circuit stub, the admittance $Y_2$ becomes a cotangent function (cot) relevant to the operating angular frequency ω. Referring to FIG. 24, the nonreciprocal phase shift amount $\beta_{NR}$ becomes zero at the operating angular frequency $\omega_Z$ that is in the vicinity of the center angular frequency $\omega_C$ and lower than the center angular frequency $\omega_C$. As described above, at this operating angular frequency $\omega_Z$, the admittances $Y_1$ and $Y_2$ are inductive (inductance), and the imaginary part of each of the admittances $Y_1$ and $Y_2$ assumes a negative value.

As indicated by the aforementioned Equation (12), the nonreciprocal phase shift amount $\beta_{NR}$ has a factor proportional to $(Y_2-Y_1)$, and this means that the frequency dependence of the nonreciprocal phase shift amount $\beta_{NR}$ is influenced by the frequency dependence of $(Y_2-Y_1)$. Referring to FIG. 24, the admittance $Y_2$ changes very gently with respect to the operating angular frequency and has no singular point. On the other hand, the admittance $Y_1$ changes with respect to the operating angular frequency more suddenly than the admittance $Y_2$ and has a plurality of periodic singular points. Therefore, the operating angular frequency $\omega_Z$ at which the nonreciprocal phase shift amount $\beta_{NR}$ becomes zero is determined substantially by the operating angular frequency corresponding to the singular points of the admittance $Y_1$. Moreover, the admittance $Y_2$, which changes more gently than the admittance $Y_1$, merely operates to increase the value of the nonreciprocal phase shift amount $\beta_{NR}$ and to shift it rightward in FIG. 2 in the calculation of the nonreciprocal phase shift amount $\beta_{NR}$ (i.e., calculation of $(Y_2-Y_1)$).

Figure 24:
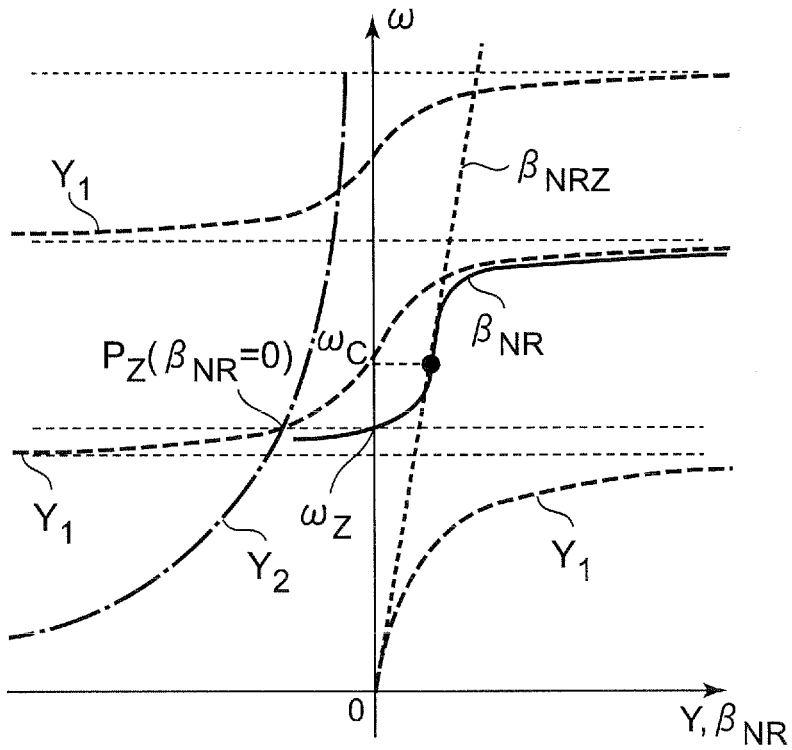
FIG. 24 is a graph showing an operating angular frequency dependence of admittances $Y_1$ and $Y_2$ in the nonreciprocal transmission line apparatus 70F of FIG. 23 and a frequency dependence of the nonreciprocal phase shift amount $\beta_{NR}$.

Referring to FIG. 24, the gradient $d\beta_{NR}/d\omega$ of the nonreciprocal phase shift amount $\beta_{NR}$ relevant to the operating angular frequency ω is determined by the operating angular frequency dependence of $(Y_2-Y_1)$, and the maximum radiation beam angle is also determined by the frequency dependence of this nonreciprocal phase shift amount $\beta_{NR}$. In concrete, the maximum radiation beam angle becomes larger as the value of $d\beta_{NR}/d\omega$ is larger. Referring to FIG. 23, in the nonreciprocal transmission line apparatus 70E, the capacitor Csh was connected to the predetermined connection point of the longer stub conductor 13A. With this arrangement, in FIG. 24, the gradient relevant to the operating angular frequency ω of $(Y_2-Y_1)$ increases, and $d\beta_{NR}/d\omega$ can be consequently increased. Therefore, the maximum radiation beam angle can be greatly improved while maintaining the state, in which the beam squint does not substantially occur as compared with the nonreciprocal transmission line apparatus 70E with no capacitor Csh.

In order to confirm the operation of the pseudo traveling wave resonator antenna using the nonreciprocal transmission line apparatus 70E in the aforementioned second case, a simulation was performed by using the ANSYS HFSS ver 13 of high-frequency three-dimensional electromagnetic analysis software.

Figure 25:
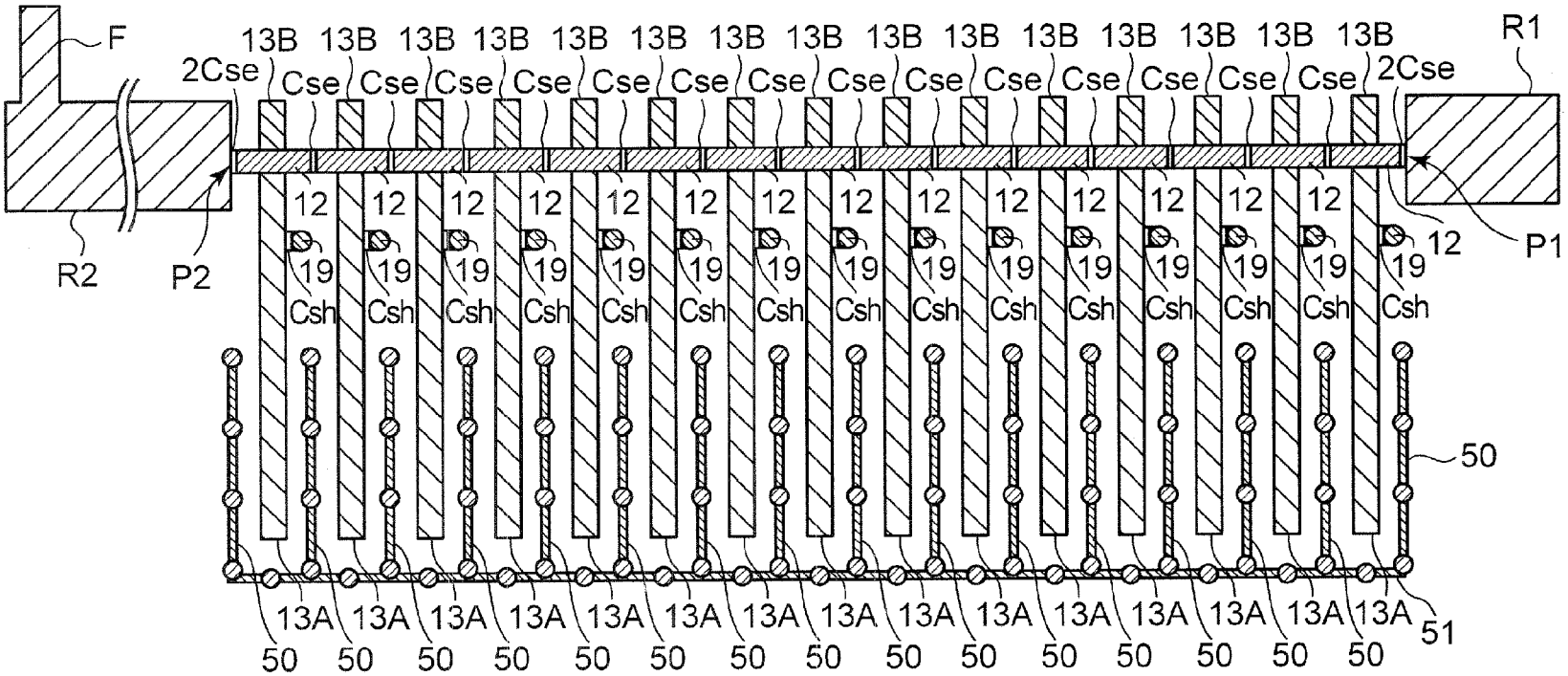
FIG. 25 is a plan view showing a concrete configuration used for the simulation of the nonreciprocal transmission line apparatus 70F of FIG. 20A.
Figure 26:
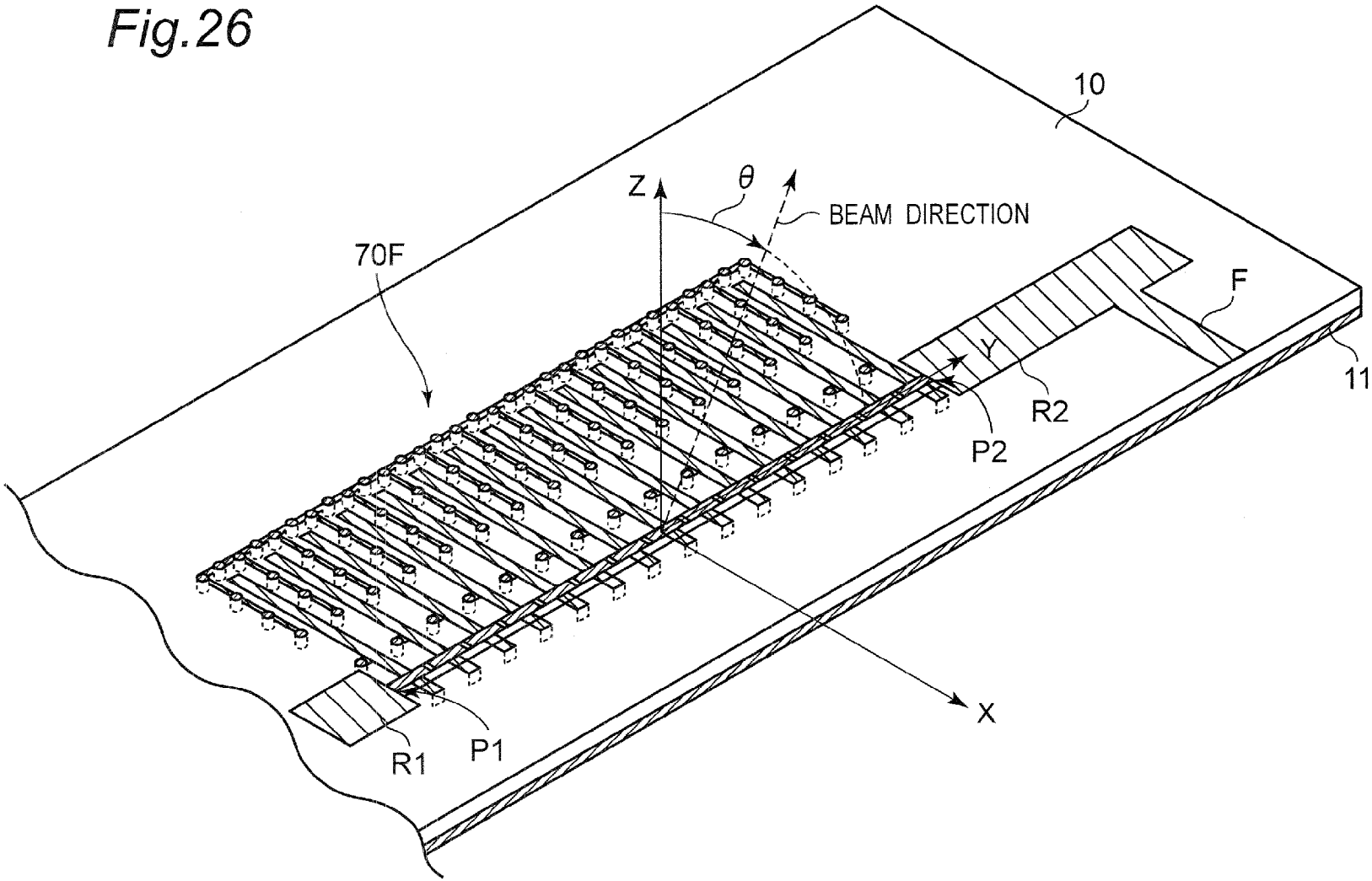
FIG. 26 is a perspective view of the nonreciprocal transmission line apparatus 70F of FIG. 25.

FIG. 25 is a plan view showing a concrete configuration used for the simulation of the nonreciprocal transmission line apparatus 70F of FIG. 23, and FIG. 26 is a perspective view of the nonreciprocal transmission line apparatus 70F of FIG. 25. In FIG. 25, the width of the strip conductor 12 was set to 0.8 mm, the electrical length La of the stub conductor 13A was set to 14 mm, and the electrical length Lb of the stub conductor 13B was set to 1.7 mm. The width of each of the stub conductors 13A and 13B was set to 1 mm, and a distance between the strip conductor 12 and the capacitor Csh was set to 2.65 mm. Moreover, the period length p was set to 3 mm, and the periodic number was set to 15. The capacitance of the capacitor Cse was set to 0.4 pF, and the capacitance of the capacitor Csh was set to 0.1 pF. Referring to FIG. 26, the stub conductor 13A is an open stub, and the stub conductor 13B is a short-circuit stub.

Further, referring to FIG. 25, a reflector R1 was connected to the port P1, a reflector R2 was connected to the port P2, and a feed line F was connected to the reflector R1. In this case, the widths in the X-axis direction of the reflectors R1 and R2 were each set to 4.5 mm. Moreover, the width in the Y-axis direction of the reflector R1 was set to 19.2 mm that is about three-fourth of the guide wavelength, and the width in the Y-axis direction of the reflector R2 was set to 6.25 mm that is about one-fourth of the guide wavelength. Further, the sectional size of the ferrite square bar 15A was set to 0.8 mm×0.8 mm. It is noted that the saturation magnetization was made to be $\mu_0 M_S$=160 mT. Moreover, in order to suppress capacitive coupling between adjacent stub conductors 13A, a grounding conductor 50 having a width thinner than the width of each of the stub conductors 13A was formed between stub conductors 13A adjacent to each other.

Figure 27:
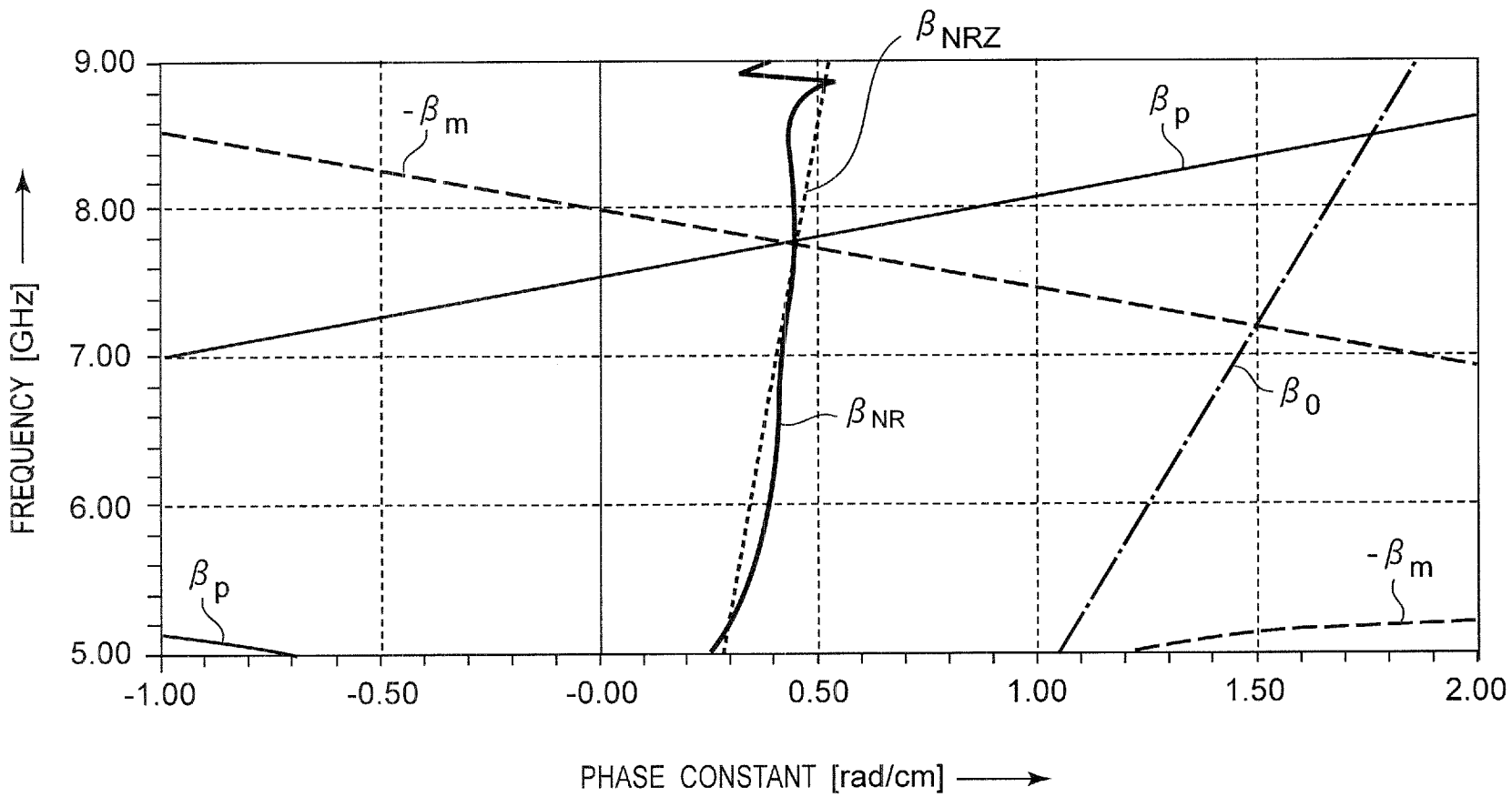
FIG. 27 is a graph showing dispersion curves of the nonreciprocal transmission line apparatus 70F of FIG. 25, and showing simulation calculated values of the frequency characteristics of the nonreciprocal phase shift amount $\beta_{NR}$.

FIG. 27 is a graph showing dispersion curves of the nonreciprocal transmission line apparatus 70F of FIG. 25, and showing simulation-calculated values of the frequency characteristics of the nonreciprocal phase shift amount $\beta_{NR}$. As shown in FIG. 27, it can be understood that the simulation-calculated values of the nonreciprocal phase shift amount $\beta_{NR}$ coincide well with the nonreciprocal phase shift amount $\beta_{NRZ}$ in the ideal case where the beam squint does not occur at all.

Figure 28:
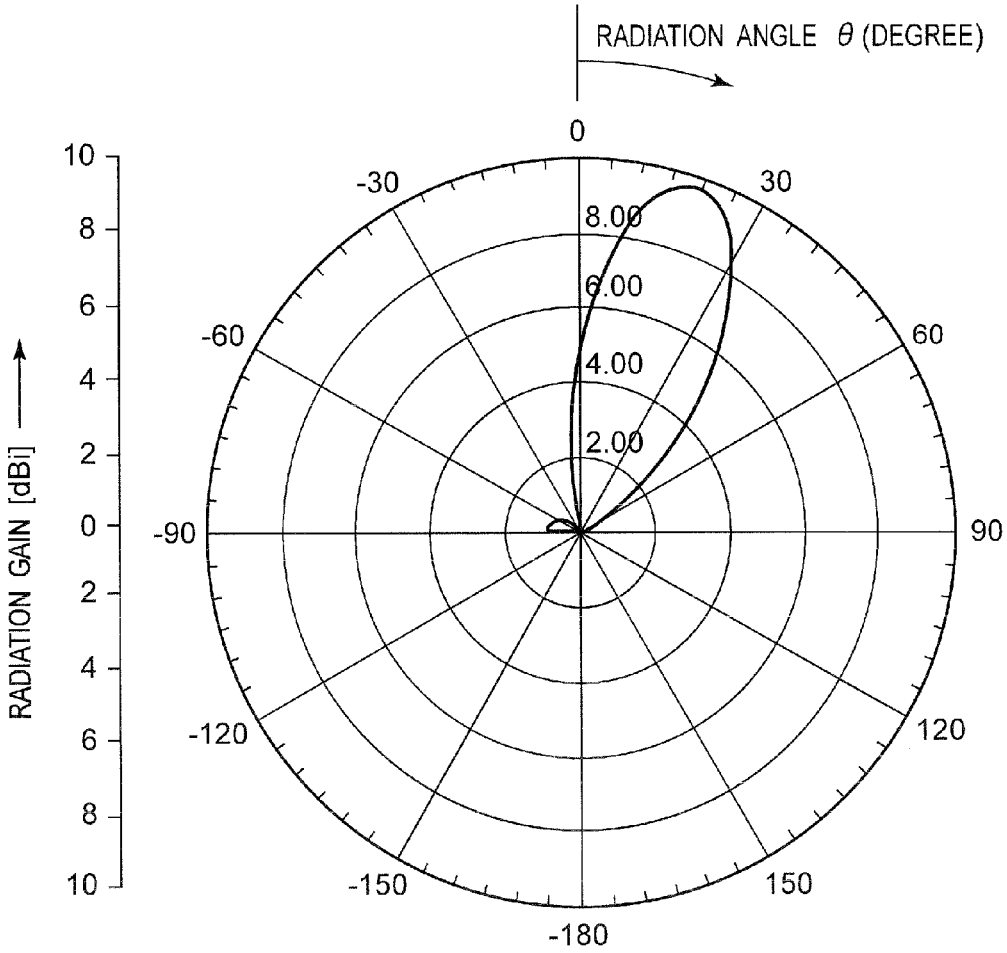
FIG. 28 is a graph showing radiation characteristics of the nonreciprocal transmission line apparatus 70F of FIG. 25.

FIG. 28 is a graph showing radiation characteristics of the nonreciprocal transmission line apparatus 70F of FIG. 25. FIG. 28 shows a case where the operating frequency is 7.35 GHz. It can be confirmed from FIG. 28 that the radiation angle θ of the main beam is inclined by 19 degrees from 0 degrees.

Figure 29:
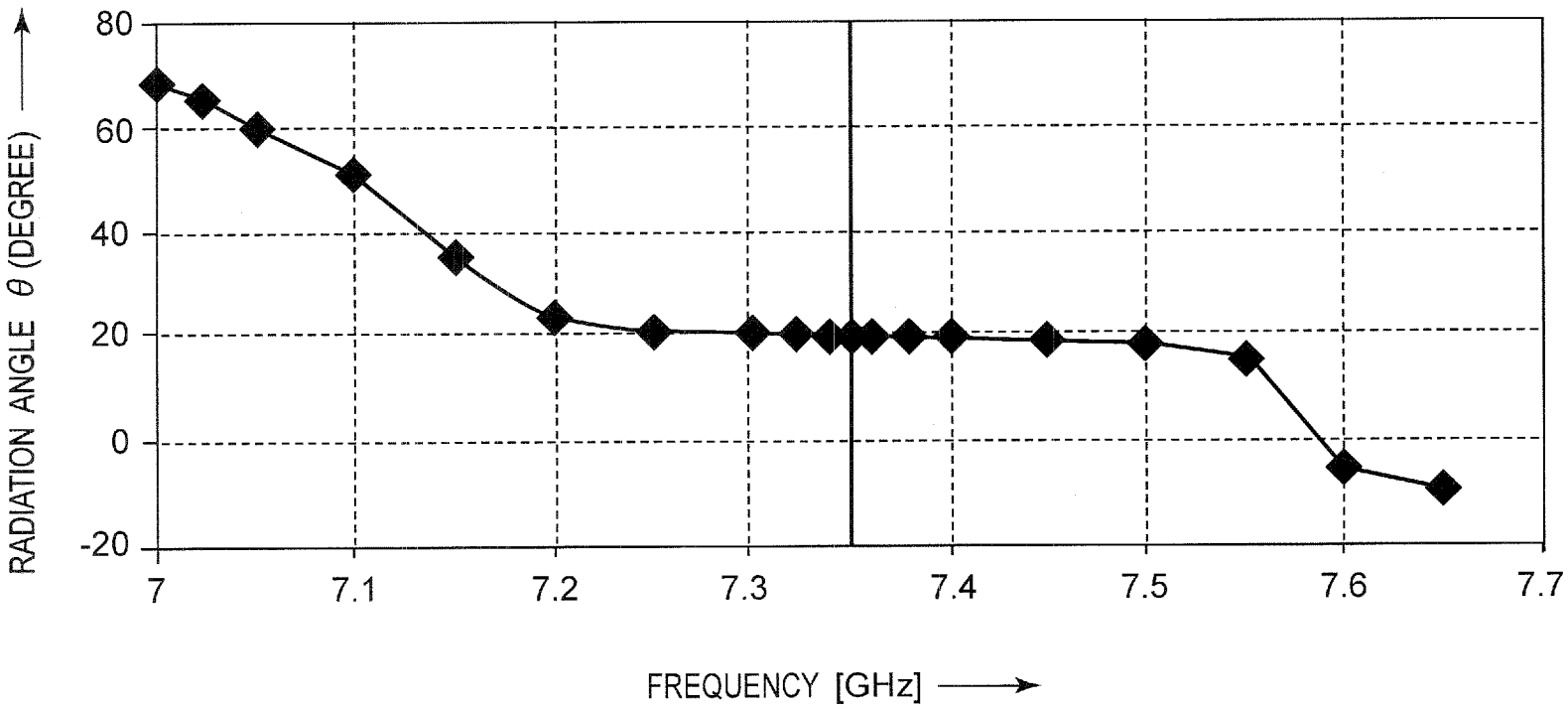
FIG. 29 is a graph showing frequency characteristics of the radiation angle $\theta$ of the nonreciprocal transmission line apparatus 70F of FIG. 25.
Figure 30:
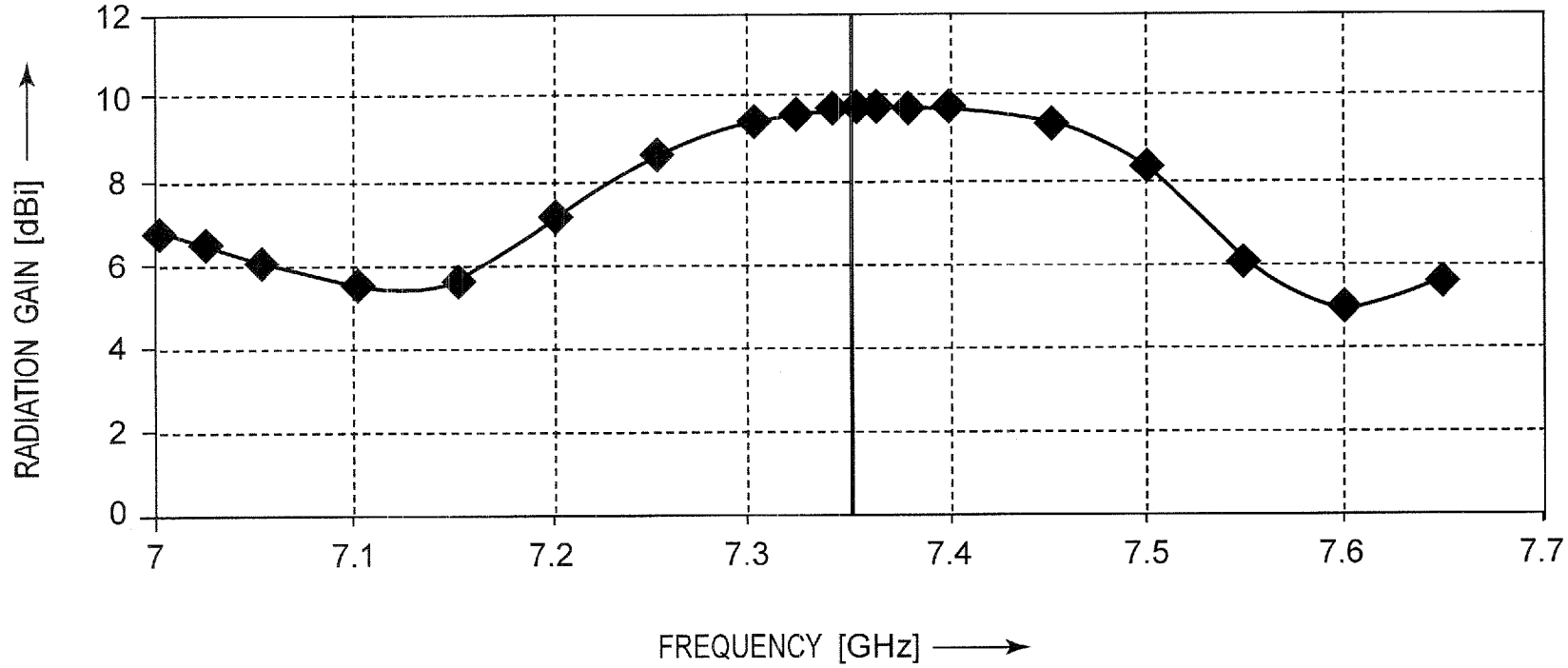
FIG. 30 is a graph showing frequency characteristics of the radiant gain of the nonreciprocal transmission line apparatus 70F of FIG. 25.

FIG. 29 is a graph showing frequency characteristics of a radiation angle θ of the nonreciprocal transmission line apparatus 70F of FIG. 25, and FIG. 30 is a graph showing frequency characteristics of a radiant gain of the nonreciprocal transmission line apparatus 70F of FIG. 25. It can be confirmed from FIG. 29 that the radiation angle θ is almost constant over for a frequency band from 7.20 GHz to 7.55 GHz. Therefore, it can be understood that an operating ratio band equal to or larger than 4% where the beam squint does not substantially occur is achieved. That is, according to the present embodiment, the operating ratio band where the beam squint does not substantially occur could be greatly improved as compared with the operating ratio band of 2% in the case where the stub conductor was provided only on one side of the strip conductor of the microstrip line 12E (See Non-Patent Document 1).

Figure 31A:
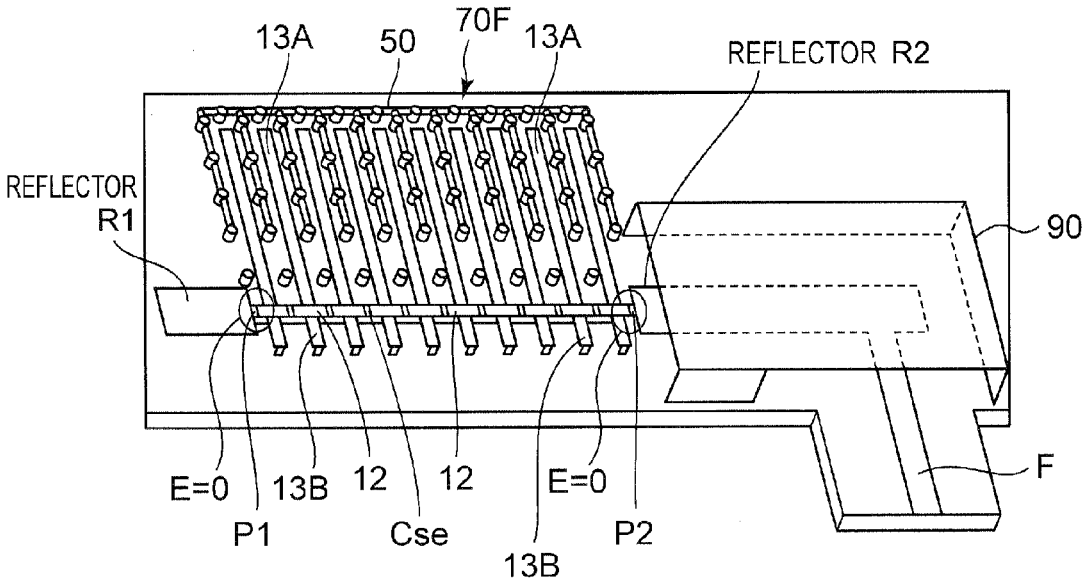
FIG. 31A is a perspective view showing a configuration of a pseudo traveling wave resonant antenna apparatus that uses the nonreciprocal transmission line apparatus 70F of FIG. 25.

FIG. 31A is a perspective view showing a configuration of a pseudo traveling wave resonant antenna apparatus that uses the nonreciprocal transmission line apparatus 70F of FIG. 25. In the pseudo traveling wave resonant antenna apparatus of FIG. 31A, the lengths of the two reflectors R1 and R2 are adjusted so that short-circuit is achieved at each of the ports P1 and P2 when viewed from the nonreciprocal transmission line apparatus 70F. The reflector R2 on the side connected to the feed line F has such a structure that is longer by half the wavelength in order to secure the connecting portion of the feed line F as compared with the reflector R2 on the non-connected side, and unnecessary radiation is consequently caused. For the suppression of this unnecessary radiation, a shield structure by a metallic shield plate 90 is adopted as the reflector R2.

Figure 31B:
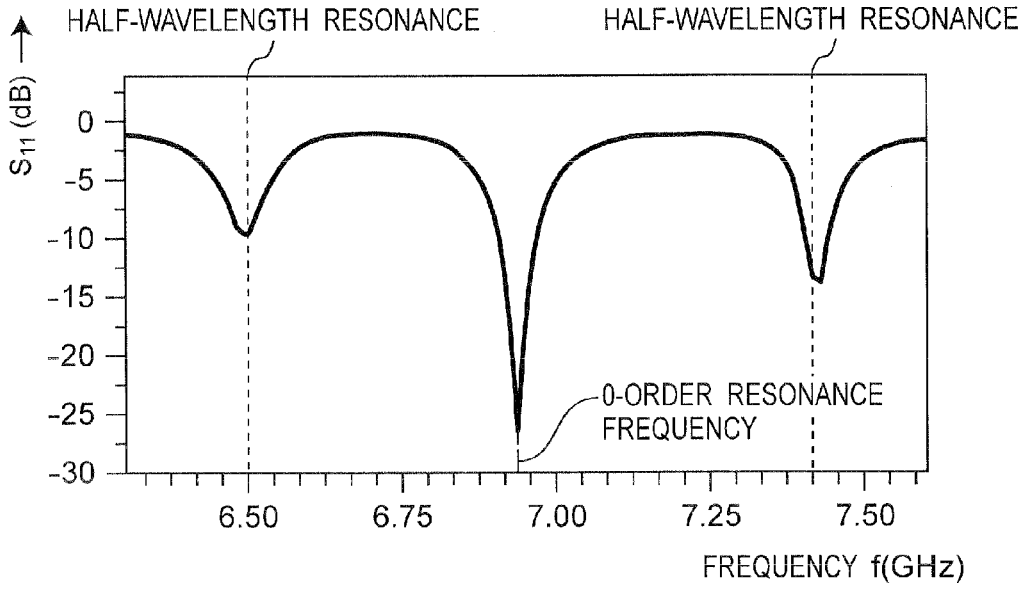
FIG. 31B is a graph of numerical calculation results of the pseudo traveling wave resonant antenna apparatus of FIG. 31A, showing frequency characteristics of a reflection coefficient $S_{11}$ when the pseudo traveling wave resonant antenna apparatus is viewed from a feed line F.

FIG. 31B is a graph of numerical calculation results of the pseudo traveling wave resonant antenna apparatus of FIG. 31A, showing frequency characteristics of a reflection coefficient $S_{11}$ when the pseudo traveling wave resonant antenna apparatus is viewed from the feed line F. The graph of FIG. 31B means that the antenna apparatus resonates at three frequencies at which the reflection is small, and electromagnetic waves are consequently radiated from this antenna apparatus. Regarding the resonance in the 6.5 GHz and 7.4 GHz bands of the three resonance frequencies, half-wavelength resonance occurs inside the CRLH line. In contrast to this, the resonance condition at 6.9 GHz operates as a pseudo traveling wave resonance to which attention is paid in the present embodiment.

Figure 31C:
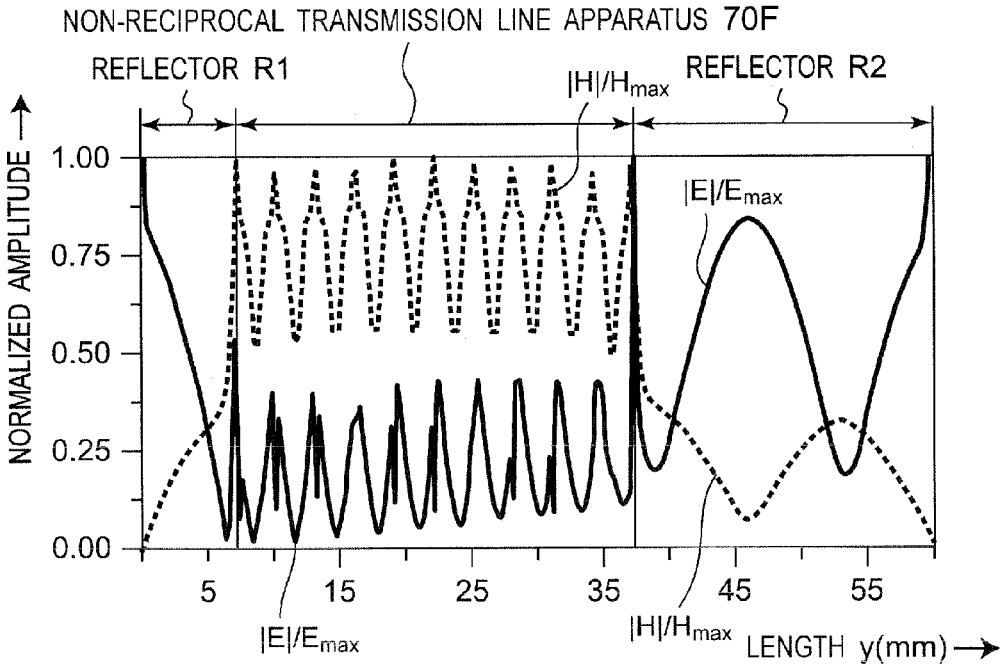
FIG. 31C is a graph of numerical calculation results of the pseudo traveling wave resonant antenna apparatus of FIG. 31A, showing a magnetic field distribution along a longitudinal direction of the nonreciprocal transmission line apparatus 70F and a normalized amplitude of the electric field distribution.

FIG. 31C is a graph of numerical calculation results of the pseudo traveling wave resonant antenna apparatus of FIG. 31A, showing a magnetic field distribution along a longitudinal direction of the nonreciprocal transmission line apparatus 70F and a normalized amplitude of an electric field distribution. As apparent from FIG. 31, such a resonance that the magnetic field is ideally dominant results, and the electric field component becomes small in the case of the both-end short-circuited resonator.

Figure 31D:
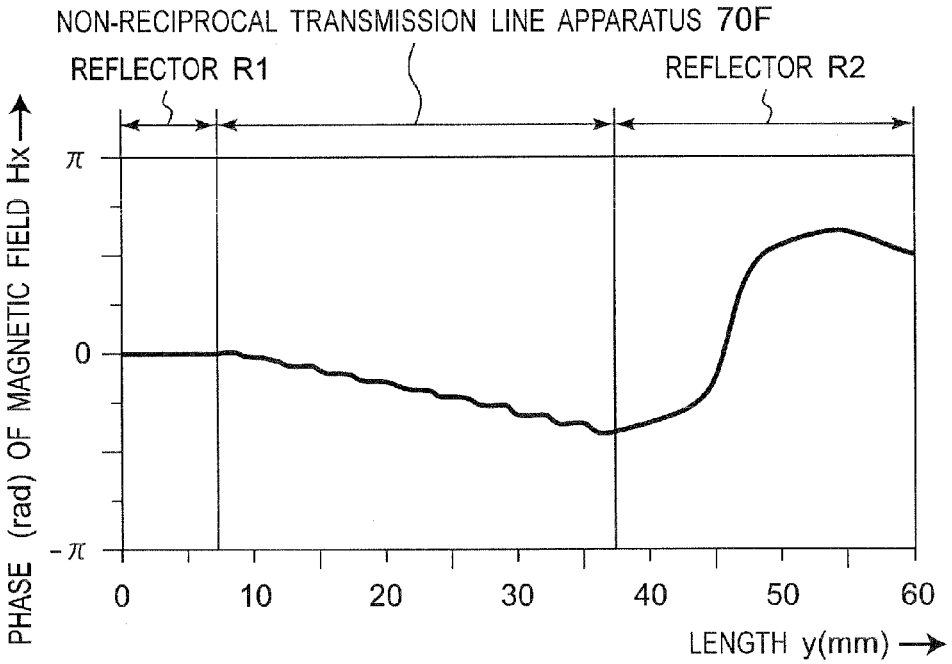
FIG. 31D is a graph of numerical calculation results of the pseudo traveling wave resonant antenna apparatus of FIG. 31A, showing a phase gradient of the magnetic field distribution along the longitudinal direction of the nonreciprocal transmission line apparatus 70F.

FIG. 31D is a graph of numerical calculation results of the pseudo traveling wave resonant antenna apparatus of FIG. 31A, showing a phase gradient of the magnetic field distribution along the longitudinal direction of the nonreciprocal transmission line apparatus 70F. As apparent from FIG. 31D, a phase change of about 70 degrees is confirmed with respect to a length of 30 mm in a portion of the nonreciprocal transmission line apparatus 70F.

Figure 31E:
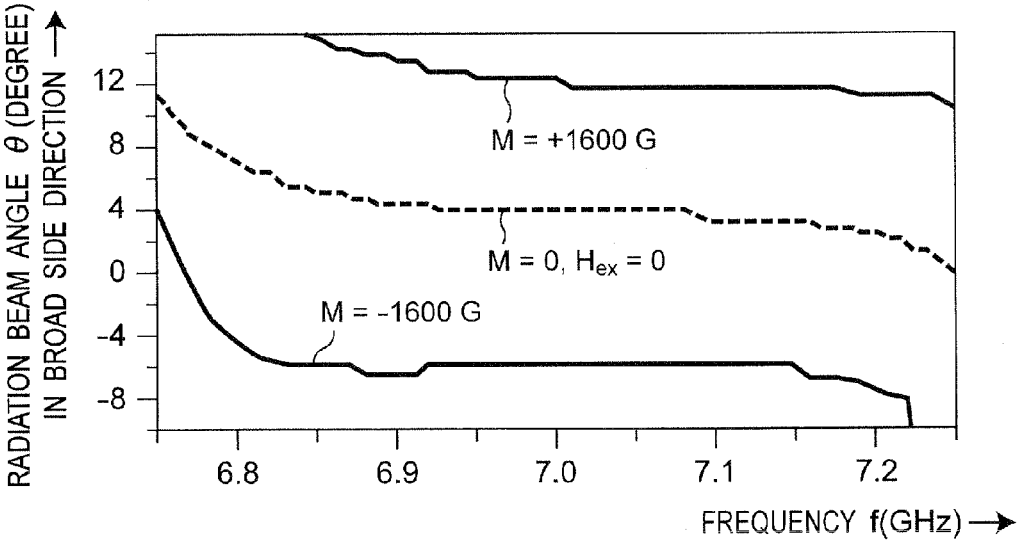
FIG. 31E is a graph of numerical calculation results of the pseudo traveling wave resonant antenna apparatus of FIG. 31A, showing frequency characteristics of a radiation beam angle in a broad side direction of the pseudo traveling wave resonant antenna apparatus.

FIG. 31E is a graph of numerical calculation results of the pseudo traveling wave resonant antenna apparatus of FIG. 31A, showing frequency characteristics of a radiation beam angle in a broad side direction of the pseudo traveling wave resonant antenna apparatus. That is, FIG. 31E plots a radiation beam angle from the pseudo traveling wave resonant antenna apparatus with respect to the broad side direction, which is used as a criterion, and exhibits the same plot as a function of the operating frequency. In the case where the magnetization is $4\pi M=-1600$ G, it is confirmed that the beam direction becomes almost constant within a range of a ratio band of 4% from 6.85 GHz to 7.15 GHz, and the beam squint is reduced. Further, it also exhibits the case where the magnitude of magnetization and the internal magnetic field is changed to $4\pi M=0$ G+1600 G. Although the effects of suppressing the beam squint deteriorates a little, a similar tendency is confirmed.

Figure 31F:
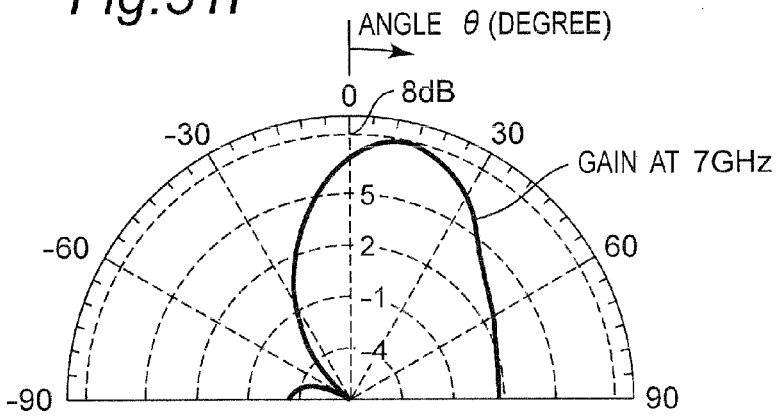
FIG. 31F is a graph of numerical calculation results of the pseudo traveling wave resonant antenna apparatus of FIG. 31A, showing a radiation pattern on a plane that includes the longitudinal direction of the pseudo traveling wave resonant antenna apparatus and a normal of a substrate.

FIG. 31F is a graph of numerical calculation results of the pseudo traveling wave resonant antenna apparatus of FIG. 31A, showing a radiation pattern in a plane perpendicular to the longitudinal direction of the pseudo traveling wave resonant antenna apparatus. As apparent from FIG. 31F, a radiation gain of 8 dBi is obtained with respect to an input signal at the operating frequency of 7 GHz in the case where the applied magnetic field $4\pi M=+1600$ G.

Figure 32A:
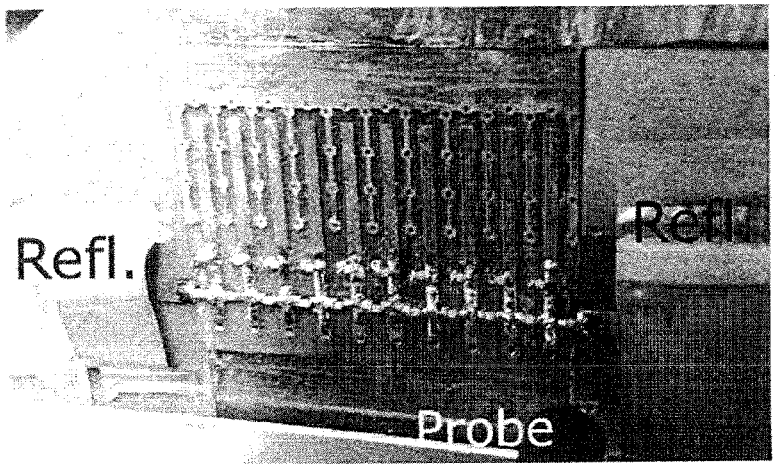
FIG. 32A is a photograph showing a trial manufacture example of the pseudo traveling wave resonant antenna apparatus of FIG. 31A.
Figure 32B:
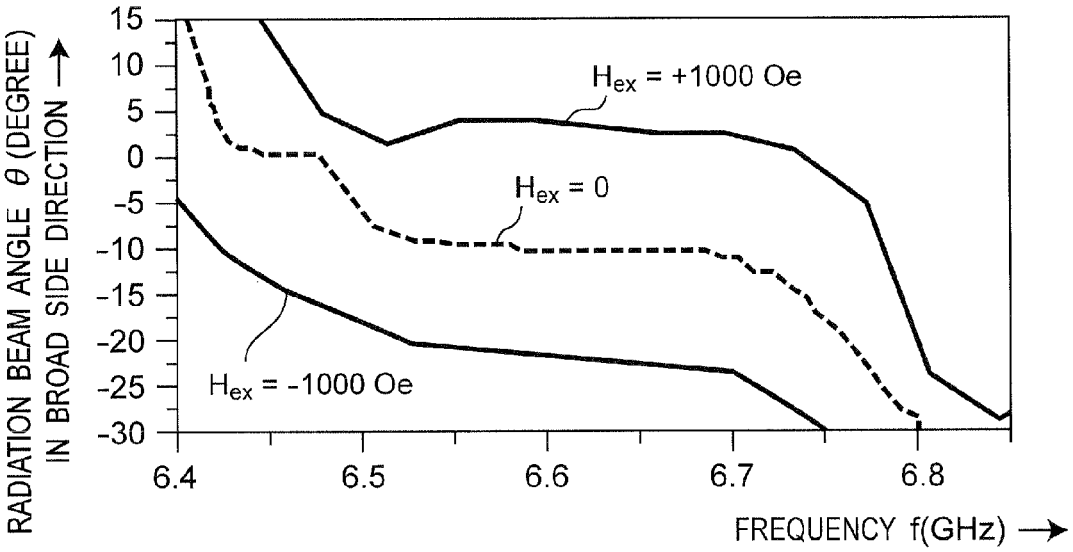
FIG. 32B is a graph of experimental results of the pseudo traveling wave resonant antenna apparatus of the trial manufacture example of FIG. 32A, showing a frequency characteristics of the radiation beam angle in the broad side direction of the pseudo traveling wave resonant antenna apparatus.

FIG. 32A is a photograph showing a trial manufacture example of the pseudo traveling wave resonant antenna apparatus of FIG. 31A, and FIG. 32B is a graph of experimental results of the pseudo traveling wave resonant antenna apparatus related to the trial manufacture example of FIG. 32A, showing frequency characteristics of the radiation beam angle in the broad side direction of the pseudo traveling wave resonant antenna apparatus. As apparent from FIG. 32A, there are shown three cases where the externally applied magnetic field Hex=−1000, 0 and +1000 Oe. The band, in which the beam squint becomes strictly zero such that the radiation beam angle does not change due to the frequency, is smaller than that of the numerical calculation results shown in FIG. 31E. However, the operation band, in which the beam squint is reduced, has been greatly improved as compared with the case of the pseudo traveling wave resonant structure having no beam squint suppression function manufactured for trial purposes in the past.

Figure 32C:
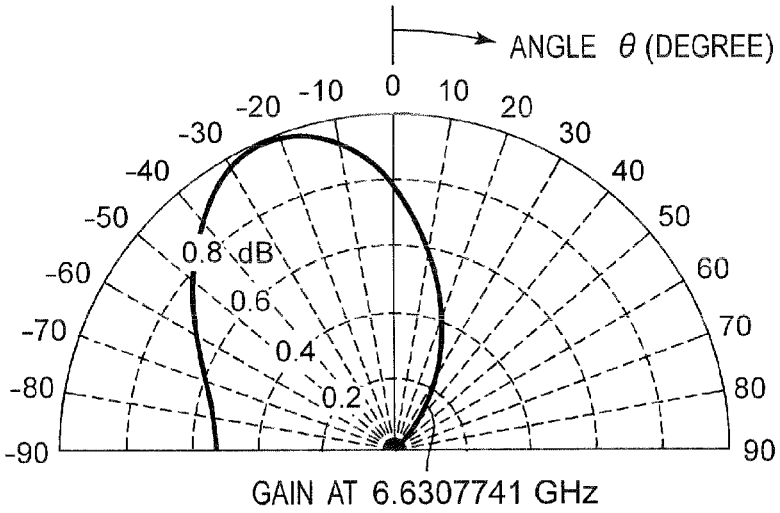
FIG. 32C is a graph of experimental results of the pseudo traveling wave resonant antenna apparatus of the trial manufacture example of FIG. 32A, showing a radiation pattern on a plane that includes a longitudinal direction of a pseudo traveling wave resonant antenna apparatus and a normal of a substrate.

FIG. 32C is a graph of experimental results of the pseudo traveling wave resonant antenna apparatus according to the trial manufacture example of FIG. 32A, showing a radiation pattern in a plane perpendicular to the longitudinal direction of the pseudo traveling wave resonant antenna apparatus. In this case, there is shown a case where the operating frequency is 6.63 GHz and the externally applied magnetic field Hex=−1000 Oe. As apparent from FIG. 32C, it can be understood that the beam is owned in a direction slightly rearward from the center in the longitudinal direction of the pseudo traveling wave resonant antenna apparatus.

It is noted that, in the nonreciprocal transmission line apparatus 70A of the embodiment, the electrical lengths La and Lb of each of the stub conductors 13A and 13B may be set as described in the embodiments and the modified embodiments.

INDUSTRIAL UTILIZABILITY

According to the nonreciprocal transmission line apparatus and the antenna apparatus of the present invention, the function of the nonreciprocal phase shift amount $\beta_{NR}=(\beta_p-\beta_m)/2$ with respect to the operating angular frequency is configured so as to come close to the function of the nonreciprocal phase shift amount $\beta_{NR}$ with respect to the operating angular frequency when the beam squint of such a phenomenon that the radiation direction of electromagnetic waves radiated from the nonreciprocal transmission line apparatus changes in accordance with the frequency does not occur. Therefore, the beam squint does not substantially occur in the vicinity of the center frequency of the operation band.

The nonreciprocal transmission line apparatuses 70A to 70F of the present invention are useful as devices and antenna apparatuses for signal transmission.

REFERENCE NUMERICALS

10: Dielectric substrate

11, 18, 22, 23, 50: Grounding conductor

12, 21, 24: Strip conductor
12A: Coplanar line
12E: Microstrip line
13A, 13B: Stub conductor
15: Ferrite plate
15A: Ferrite square bar
17A, 17B: Grounding conductor
60A to 60F: Unit cell
61, 62: Transmission line section
70A-60F: Nonreciprocai transmission line apparatus
80: External magnetic field generator
C, C1, C2, C60, Cse, Csh: Capacitor
P1, P2, P11, P12: Port

The invention claimed is:

1. A nonreciprocal transmission line apparatus configured by connecting in cascade at least one unit cell, each unit cell including:

(a) a microwave transmission line section;

(b) a series branch circuit equivalently including a capacitance element; and (c) first and second parallel branch circuits provided branched from the transmission line section, each of the first and second parallel branch circuit equivalently including an inductive element between first and second ports, wherein a propagation constant in a forward direction and a propagation constant in a backward direction of the nonreciprocal transmission line apparatus are different from each other, wherein the transmission line section of each unit cell has spontaneous magnetization so as to have gyro anisotropy by being magnetized in a direction different from a propagation direction of microwaves or by being externally magnetized by an external magnetic field, wherein the first parallel branch circuit is a first stub conductor having a first electrical length, wherein the second parallel branch circuit is a second stub conductor having a second electrical length shorter than the first electrical length, and wherein, when a phase constant in a first mode of propagation in the forward direction is $\beta_p$, and a phase constant in a second mode of propagation in the backward direction is $\beta_m$, the first and second electrical lengths are set so that a function of nonreciprocal phase shift amount $\beta_{NR}=(\beta_p-\beta_m)/2$ with respect to the operating angular frequency comes close to a function of nonreciprocal phase shift amount $\beta_{NRZ}$ with respect to an operating angular frequency, when beam squint of such a phenomenon that a radiation direction of electromagnetic waves radiated from the nonreciprocal transmission line apparatus changes in accordance with frequency does not occur in the vicinity of an intersection of a dispersion curve representing a relation between the phase constant $\beta_p$ and the operating angular frequency and a dispersion curve representing a relation between the phase constant $\beta_m$ and the operating angular frequency.

2. The nonreciprocal transmission line apparatus as claimed in claim 1, wherein the function is a function proportional to the operating angular frequency.

3. The nonreciprocal transmission line apparatus as claimed in claim 2, wherein the first stub conductor has a first admittance, wherein the second stub conductor has a second admittance, and wherein the first and second electrical lengths are set such that:

(a) the first admittance substantially coincides with the second admittance at a predetermined operating angular frequency lower than the operating angular frequency at the intersection, and (b) respective imaginary parts of the first and second admittances are negative at the predetermined operating angular frequency.

4. The nonreciprocal transmission line apparatus as claimed in claim 3, wherein the first stub conductor is a short-circuit stub, and the first electrical length is set to be longer than one-half of a guide wavelength, and wherein the second stub conductor is a short-circuit stub, and the second electrical length is set to be shorter than one-fourth of the guide wavelength.

5. The nonreciprocal transmission line apparatus as claimed in claim 3, wherein the first stub conductor is an open stub, and the first electrical length is set to be longer than one-fourth of a guide wavelength, and wherein the second stub conductor is a short-circuit stub, and the second electrical length is set to be shorter than one-fourth of the guide wavelength.

6. The nonreciprocal transmission line apparatus as claimed in claim 1, further comprising a grounding conductor provided between the first stub conductors, the grounding conductor providing a shield between the first stub conductors.

7. An antenna apparatus comprising a nonreciprocal transmission line apparatus configured by connecting in cascade at least one unit cell, each unit cell including:

(a) a microwave transmission line section;

(b) a series branch circuit equivalently including a capacitance element; and (c) first and second parallel branch circuits provided branched from the transmission line section, each of the first and second parallel branch circuit equivalently including an inductive element between first and second ports, wherein a propagation constant in a forward direction and a propagation constant in a backward direction of the nonreciprocal transmission line apparatus are different from each other, wherein the transmission line section of each unit cell has spontaneous magnetization so as to have gyro anisotropy by being magnetized in a direction different from a propagation direction of microwaves or by being externally magnetized by an external magnetic field, wherein the first parallel branch circuit is a first stub conductor having a first electrical length, wherein the second parallel branch circuit is a second stub conductor having a second electrical length shorter than the first electrical length, and wherein, when a phase constant in a first mode of propagation in the forward direction is $\beta_p$, and a phase constant in a second mode of propagation in the backward direction is $\beta_m$, the first and second electrical lengths are set so that a function of nonreciprocal phase shift amount $\beta_{NR}=(\beta_p-\beta_m)/2$ with respect to the operating angular frequency comes close to a function of nonreciprocal phase shift amount $\beta_{NRZ}$ with respect to an operating angular frequency, when beam squint of such a phenomenon that a radiation direction of electromagnetic waves radiated from the nonreciprocal transmission line apparatus changes in accordance with frequency does not occur in the vicinity of an intersection of a dispersion curve representing a relation between the phase constant $\beta_p$ and the operating angular frequency and a dispersion curve representing a relation between the phase constant $\beta_m$ and the operating angular frequency.

* * * * *